US006846601B2

(12) United States Patent
Shimojo et al.

(10) Patent No.: US 6,846,601 B2
(45) Date of Patent: Jan. 25, 2005

(54) NEGATIVELY CHARGEABLE TONER, IMAGE-FORMING METHOD AND PROCESS CARTRIDGE

(75) Inventors: Minoru Shimojo, Kanagawa (JP); Satoshi Matsunaga, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/383,617

(22) Filed: Mar. 10, 2003

(65) Prior Publication Data

US 2003/0224275 A1 Dec. 4, 2003

(30) Foreign Application Priority Data

Mar. 11, 2002 (JP) ..... 2002-064928

(51) Int. Cl.[7] ..... G03G 9/087

(52) U.S. Cl. ..... 430/108.22; 430/111.41; 430/108.6; 430/124; 430/126; 101/262

(58) Field of Search ..... 430/108.22, 111.41, 430/108.6, 124, 126, 109.4, 108.7, 122; 101/262

(56) References Cited

U.S. PATENT DOCUMENTS

| | | | | |
|---|---|---|---|---|
| 4,883,735 A | | 11/1989 | Watanabe et al. | 430/109 |
| 5,418,102 A | | 5/1995 | Kotaki et al. | 430/109 |
| 5,597,673 A | | 1/1997 | Watanabe et al. | 430/96 |
| 5,849,449 A | * | 12/1998 | Wilson | 430/108.11 |
| 6,635,398 B1 | * | 10/2003 | Komoto et al. | 430/108.23 |
| 2002/0045120 A1 | | 4/2002 | Yoshikawa et al. | 430/108.5 |

FOREIGN PATENT DOCUMENTS

| | | |
|---|---|---|
| JP | 61-198249 | 9/1986 |
| JP | 63-184762 | 7/1988 |
| JP | 2-167565 | 6/1990 |
| JP | 8-123096 | 5/1996 |
| JP | 9-166887 | 6/1997 |
| JP | 00/305318 | 11/2000 |
| JP | 01/305793 | 11/2001 |

* cited by examiner

*Primary Examiner*—John L Goodrow
(74) *Attorney, Agent, or Firm*—Fitzpatrick, Cella, Harper & Scinto

(57) ABSTRACT

In a negatively chargeable toner having i) negatively chargeable toner particles containing at least a binder resin, a colorant and a vinyl copolymer and ii) an inorganic fine powder, the negatively chargeable toner has a weight-average particle diameter of from 4 μm to 12 μm and contains, in particle size distribution of the toner, less than 50% by volume of particles of 10.1 μm or more in particle diameter, and the vinyl copolymer is a vinyl copolymer obtained by copolymerizing a monomer composition which contains at least i) a vinyl monomer such as an N-substituted acryl- or methacrylamide or a ring-structure acryl- or methacrylamide and ii) a vinyl monomer having as a functional group a carboxyl group or a carboxyl group made into salt structure. An image-forming method and a process cartridge make use of such a negatively chargeable toner.

24 Claims, 7 Drawing Sheets

NEGATIVELY CHARGEABLE TONER, IMAGE-FORMING METHOD AND PROCESS CARTRIDGE

BACKGROUND OF THE INVENTION

1. Field of the Invention

This invention relates to a negatively chargeable toner used in recording processes which utilize electrophotography, electrostatic recording, electrostatic printing, toner jet system recording and the like, and also relates to an image-forming method and a process cartridge.

2. Related Background Art

In electrophotography, copied or printed images are commonly obtained by utilizing a photoconductive material and by forming an electrostatic latent image on a photosensitive member by various means, subsequently developing the electrostatic latent image by the use of a toner to form a toner image, and transferring the toner image to a transfer material such as paper as occasion calls, followed by fixing by the action of heat, pressure, heat-and-pressure or solvent vapor.

As developing systems applied in these electrophotographic processes, they are roughly classified into dry-process developing systems and wet-process developing systems. The former is further classified into a system making use of two-component developers and a system making use of one-component developers.

As toners used in such dry-process developing systems, particles of a binder resin in which a colorant has been dispersed and which has been pulverized to have particle diameters of approximately from 5 $\mu$m to 15 $\mu$m are used as a toner, for example. As magnetic toners which are one-component developers, those incorporated with magnetic fine particles as a colorant are used. In the case of the two-component developers, toners are also used in the form of a blend of a toner incorporated with carbon black or pigment as a colorant and carrier particles such as iron powder or magnetic ferrite particles.

In either developing system toners, toner particles must positively or negatively electrostatically be charged in accordance with the polarity of the electrostatically charged image to be developed.

To provide the toner particles with electric charges, the triboelectric chargeability of binder resins of toners may be utilized. In this case, however, the toner particles have so small charge quantity that the images formed by development may have a low image density and tend to fog, tending to be unsharp images.

Accordingly, in order to endow the toners with the desired triboelectric chargeability, dyes, pigments or polymeric compounds are added as charge control agents. As charge control agents for positive chargeability, nigrosine dyes, azine dyes, copper phthalocyanine pigments and quaternary ammonium salts are used. As charge control agents for negative chargeability, organometallic compounds of monoazo dyes and organometallic compounds of salicylic acid, naphthoic acid or dicarboxylic acid are used. However, such charge control agents stand colored in many cases, and may cause a problem in color reproducibility when used in color toners. Thus, chargeability control resins which are almost colorless or not so colored attract notice.

For example, Japanese Patent Application Laid-Open No. 63-184762 discloses a toner which has a binder resin comprised of a copolymer of styrene and/or $\alpha$-methylstyrene with an acrylic or methacrylic alkyl ester and contains a copolymer of styrene and/or $\alpha$-methylstyrene with 2-acrylamido-2-methylpropanesulfonic acid.

Japanese Patent Application Laid-Open No. 2-167565 also discloses a toner containing i) a chargeability control resin comprised of a sulfonic-acid-containing acrylamide monomer and a vinyl monomer and ii) a charge control agent other than this.

Japanese Patent Application Laid-Open No. 8-123096 discloses a toner containing i) a charge control agent containing an iron element and ii) a copolymer of a styrene/acrylic monomer with a sulfonic-acid-containing acrylamide monomer.

Japanese Patent Application Laid-Open No. 2000-305318 discloses a negatively chargeable toner containing a polymer having a sulfonic-acid group such as 2-acrylamido-2-methylpropanesulfonic acid.

When such polymeric compounds are used as charge control agents, it is difficult for them to be dispersed in toner's binder resins which are relatively hydrophobic, because the sulfonic-acid-group-containing monomer component such as 2-acrylamido-2-methylpropanesulfonoc acid is strongly hydrophilic. Especially in a running test where images are formed on many sheets in a high-temperature and high-humidity environment, such compounds tend to cause a decrease in image density and an increase in fog. According to studies made by the present inventors, in order to improve their initial charge characteristics of toners and their dispersibility in binder resins, the sulfonic-acid-group-containing monomer must be made more hydrophilic in molecular structure. Thus, it has not been sayable to be sufficient to merely somewhat change copolymerizable monomers.

Japanese Patent Applications Laid-Open Nos. 9-166887 and 2001-305793 disclose toners containing a copolymer with a styrene/acrylic monomer having a specific carboxylic-acid monomer (succinic-acid monohydroxyethyl methacrylate). When the above copolymer is used as a charge control agent, it is difficult to use it in toners because of its insufficient charge-providing performance. Hence, it has been necessary to use a conventionally known charge control agent in combination.

Japanese Patent Application Laid-Open No. 61-198249 also discloses a toner comprised of a binder resin having as a constituent unit a monomer containing an amino group. This binder resin, however, is a binder resin for positive charging which contains an alkylene group in the monomer at the same time, and is not a resin which can attain satisfactory charging performance when applied in negatively chargeable toners.

SUMMARY OF THE INVENTION

An object of the present invention is to provide a negatively chargeable toner having solved the above problems.

More particularly, an object of the present invention is to provide a negatively chargeable toner well capable of preventing fog and having superior image density stability; and provide an image-forming method and a process cartridge which make use of such a toner.

Another object of the present invention is to provide a negatively chargeable toner containing a vinyl copolymer having good dispersibility in a binder resin of the negatively chargeable toner, and promising superior initial-stage charging rise performance of the negatively chargeable toner regardless of any environment; and provide an image-forming method and a process cartridge which make use of such a toner.

The present invention is a negatively chargeable toner having i) negatively chargeable toner particles containing at least a binder resin, a colorant and a vinyl copolymer and ii) an inorganic fine powder;

the negatively chargeable toner having a weight-average particle diameter of from 4 $\mu$m to 12 $\mu$m, and containing, in particle size distribution of the toner, less than 50% by volume of particles of 10.1 $\mu$m or more in particle diameter; and the vinyl copolymer being a vinyl copolymer obtained by copolymerizing a monomer composition which contains at least a vinyl monomer represented by the following formula (1):

(1)

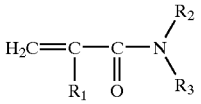

wherein $R_1$ represents a hydrogen atom or a methyl group; and $R_2$ and $R_3$ each represent a hydrogen atom or an alkyl group which may be substituted with a substituent except for an acid group, or $R_2$ and $R_3$ may be combined to form an organic group to form a cyclic structure together with the nitrogen atom; and a vinyl monomer having as a functional group a carboxyl group or a carboxyl group made into salt structure.

The present invention is also an image-forming method comprising a developing step of developing an electrostatic latent image held on an image-bearing member for holding thereon the electrostatic latent image, by the use of a negatively chargeable toner to form a negatively chargeable toner image; a transfer step of transferring the negatively chargeable toner image formed on the image-bearing member, to a recording medium via, or not via, an intermediate transfer member; and a fixing step of heat-fixing to the recording medium the negatively chargeable toner image transferred to the recording medium;

the negatively chargeable toner being the negatively chargeable toner constituted as described above.

The present invention is further a process cartridge constructed detachably mountable to the main body of an image-forming apparatus;

the process cartridge comprising an image-bearing member and a developing means which are supported as one unit; the developing means developing an electrostatic latent image held on the image-bearing member, by the use of a negatively chargeable toner to form a negatively chargeable toner image;

the negatively chargeable toner being the negatively chargeable toner constituted as described above.

DESCRIPTION OF THE PREFERRED EMBODIMENTS

Figure 1:
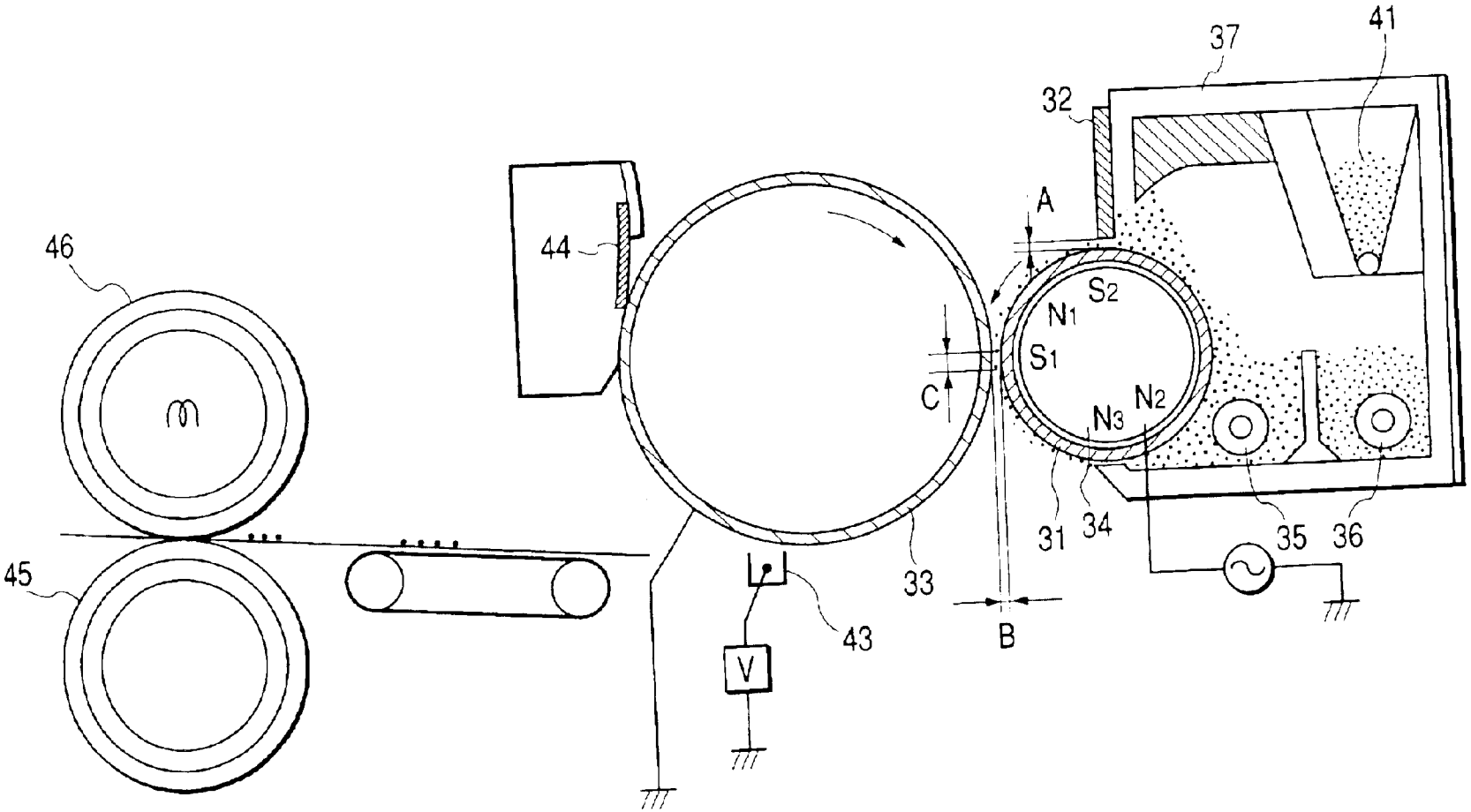
FIG. 1 is a schematic view of an image-forming apparatus to which the negatively chargeable toner of the present invention is applicable.

As a result of studies made by the present inventors, they have discovered that, in a negatively chargeable toner containing a vinyl copolymer having charge controllability, it is important to control the state of dispersion of the vinyl copolymer in the binder resin of the negatively chargeable toner in order to materialize good image density stability in any environment including low-humidity environment up to high-humidity environment.

More specifically, they have discovered the following: If in the negatively chargeable toner particles the vinyl copolymer is present in the binder resin component in the state the both have completely melted together, the rise of charging of the negatively chargeable toner is not improved. If on the other hand the vinyl copolymer is present in the binder resin component in a completely phase-separated state, the environmental stability of charging of the negatively chargeable toner is not improved. To solve this, in the vinyl copolymer, at least a vinyl monomer represented by the following formula (1) which contributes to charge controllability (hereinafter "monomer (A)"):

(1)

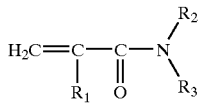

wherein $R_1$ represents a hydrogen atom or a methyl group; and $R_2$ and $R_3$ each represent a hydrogen atom or an alkyl group which may be substituted with a substituent except for an acid group, or $R_2$ and $R_3$ may be combined to form an organic group to form a cyclic structure together with the nitrogen atom; and a vinyl monomer having as a functional group a carboxyl group or a carboxyl group made into salt structure (hereinafter "monomer (B)") may be made simultaneously present in its structure, and preferably the polymerization ratio of these monomers may be controlled to make the vinyl copolymer have its acid value, glass transition temperature and molecular weight within specific ranges. This can achieve rapid rise of charging of the negatively chargeable toner and retention of charge quantity in a high-temperature and high-humidity environment, and can materialize a good state of dispersion of the vinyl copolymer in the binder resin of the negatively chargeable toner.

Incidentally, the "vinyl monomer" is strictly meant to be a monomer having "$CH_2$=CH—". In the present specification, however, the term is also used to include "$CH_2$=CR— (R: a substituent such as an alkyl group).

The monomer (A) represented by the above formula (1) may include, e.g., acryl- or methacrylamide; N-substituted acryl- or methacrylamides such as N,N-dimethyl acryl- or methacrylamide, N-methyl acryl- or methacrylamide, N-isopropyl acryl- or methacrylamide and N-methylolacryl- or methacrylamide; acryl- or methacrylamides containing cyclic structure, such as N-acryl- or methacryloyl morpholine, N-acryl- or methacryloyl pyrrolidone, N-acryl- or methacryloyl piperidine and N-acryl- or methacryloyl pyrrolidine and N-acryl- or methacryloyl-4-piperidone. Any one of these may be used alone or two or more of these may be used in combination.

The monomer (B) may include, e.g., maleic acid, half-esterified products of maleic acid, fumaric acid, half-esterified products of fumaric acid, itaconic acid, half-esterified products of itaconic acid, crotonic acid and cinnamic acid. From the viewpoint of controlling the state of dispersion in the binder resin, the monomer (B) may preferably be a vinyl monomer represented by the following formula (2) or (3).

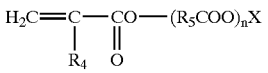

(2)

wherein $R_4$ represents a hydrogen atom or a methyl group; $R_5$ represents an alkylene group having 2 to 6 carbon atoms; n represents an integer of 0 to 10; and X represents a hydrogen atom, an alkali metal, an alkaline earth metal or a quaternary ammonium group.

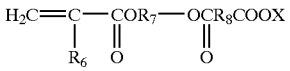

(3)

wherein $R_6$ represents a hydrogen atom or a methyl group; $R_7$ represents an alkylene group having 2 to 4 carbon atoms; $R_8$ represents an ethylene group, a vinylene group, a 1,2-cyclohexylene group or a phenylene group; and X represents a hydrogen atom, an alkali metal, an alkaline earth metal or a quaternary ammonium group.

The vinyl monomer represented by the above formula (2) may preferably be one in which the X in the formula is a hydrogen atom, to have a carboxyl group, and may include e.g., acrylic or methacrylic acid, acrylic or methacrylic acid dimer, ω-carboxy-polycaprolactone monoacryl- or methacrylate. The vinyl monomer represented by the above formula (3) may preferably be one in which the X in the formula is a hydrogen atom, to have a carboxyl group, and may include e.g., succinic-acid monohydroxyethyl acryl- or methacrylate, maleic-acid monohydroxyethyl acryl- or methacrylate, fumaric-acid monohydroxyethyl acryl- or methacrylate, phthalic-acid monohydroxyethyl acryl- or methacrylate and 1,2-dicarboxycyclohexane monohydroxyethyl acryl- or methacrylate.

Any one of these may be used alone or two or more of these may be used in combination.

In the negatively chargeable toner of the present invention, the vinyl copolymer obtained by copolymerization of the monomer (A) with the monomer (B) may contain other monomer as a copolymerization component, which may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylate type monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone. Any one of these may be used alone or two or more of these may be used in combination. In particular, styrene is preferred in view of advantages that it is inexpensive, has good copolymerizability with other vinyl monomers, enables easy adjustment of the Tg (glass transition temperature) of the copolymer and can attain superior dispersibility in the toner. In addition, in the vinyl copolymer contained in the negatively chargeable control resin, units derived from styrene may preferably be contained in an amount of 60% by weight or more, and particularly 70% by weight or more.

In the negatively chargeable toner of the present invention, as the vinyl copolymer, the monomer (A) and the monomer (B) may preferably be copolymerized in an amount of from 0.5% by weight to 20% by weight each, and more preferably from 2% by weight to 15% by weight each. If these monomers are copolymerized in an amount of less than 0.5% by weight each, any sufficient image density may not be achieved in a high-humidity environment, and, if they are copolymerized in an amount of more than 20% by weight each, fog tends to increase, undesirably.

In the negatively chargeable toner of the present invention, the monomer (A) and the monomer (B) may preferably stand copolymerized in the vinyl copolymer in a proportion by weight of from 1:5 to 3:1, more from 1:4 to 2:1, and still more preferably from 1:3 to 1:1. If the monomer (A) and the monomer (B) stand copolymerized in a copolymerization ratio of less than 1:5 or in a copolymerization ratio of more than 3:1, in either case the dispersibility of the vinyl copolymer in the binder resin may lower to cause a decrease in image density especially in a running test in a high-temperature and high-humidity environment.

In the negatively chargeable toner of the present invention, the vinyl copolymer may preferably have an acid value of from 5 mg·KOH/g to 50 mg·KOH/g, and more preferably from 10 mg·KOH/g to 40 mg·KOH/g. If the vinyl copolymer has an acid value of less than 5 mg·KOH/g, the negatively chargeable toner may have poor rise of charging, and, if it has an acid value of more than 50 mg·KOH/g, the toner may come charged in excess even in a normal-temperature and normal-humidity environment to cause a decrease in image density, undesirably.

In the negatively chargeable toner of the present invention, the vinyl copolymer may preferably have a weight-average molecular weight (Mw) of from 2,000 to 200,000, more preferably from 5,000 to 100,000, and still more preferably from 10,000 to 50,000. If it has an Mw of less than 2,000 or more than 200,000, in either case it is difficult to bring the state of dispersion of the vinyl copolymer in the binder resin into the state favorable for the present invention, undesirably.

In the negatively chargeable toner of the present invention, the vinyl copolymer may have a glass transition temperature (Tg) of from 50° C. to 120° C., and preferably from 70° C. to 100° C. If it has a Tg of less than 50° C. or more than 120° C., in either case it is difficult to bring the state of dispersion of the vinyl copolymer in the binder resin into the state favorable for the present invention, undesirably.

In the negatively chargeable toner of the present invention, the vinyl copolymer may be produced by various polymerization methods. As a preferable polymerization method, it is a case in which it is produced by bulk polymerization or solution polymerization which does not use any polymerization solvent or use a polymerization solvent only in a small quantity. As a reaction solvent, it may include known solvents such as methanol, ethanol, propanol, 2-propanol, propanone, 2-butanone, dioxane, toluene and xylene, any of which may be used alone or in the form of a mixture.

In the negatively chargeable toner of the present invention, in producing the vinyl copolymer, a polymerization initiator of various types may be used, which may include, e.g., azo type polymerization initiators such as 2,2'-azobis(4-methoxy-2,4-dimethylvaleronitrile), 2,2'-azobis(2,4-dimethylvaleronitrile), 2,2'-azobis(2-methylpropionitrile), 2,2'-azobis(2-butyronitrile), 1,1'-azobis(cyclohexane-1-carbonitrile), dimethyl 2,2'-azobis (methylpropionate), 4,4'-azobis(4-cyanopentanoic acid), 2,2'-azobis(2,2,4-pentane) and 1,1'-azobis(1-acetoxy-1-phenylethane); and peroxide type polymerization initiators such as benzoyl peroxide, lauroyl peroxide, dicumyl peroxide, tert-butyl peroxycumene and di-tert-butyl peroxide. Of these, 2,2'-azobis(2-butyronitrile), 4,4'-azobis(4-cyanopentanoic acid), 1,1'-azobis(1-acetoxy-1-phenylethane) may particularly preferably be used.

The negatively chargeable toner of the present invention may preferably contain the vinyl copolymer in an amount of from 0.1% by weight to 20% by weight, and more preferably from 0.5% by weight to 10% by weight. If it is in a content of less than 0.1% by weight, the toner may have an insufficient charge quantity. If it is in a content of more than 20% by weight, the toner may have a non-uniform charge quantity. In either case, image density tends to decrease and fog tends to occur conspicuously especially in a high-temperature and high-humidity environment.

The negatively chargeable toner of the present invention may have a weight-average particle diameter of from 4 μm to 12 μm, and, in the particle size distribution of the negatively chargeable toner, may contain less than 50% by volume of particles of 10.1 μm or more in particle diameter. It may preferably have a weight-average particle diameter of from 5 μm to 9 μm and contain 30% by volume or less of particles of 10.1 μm or more in particle diameter, and may more preferably have a weight-average particle diameter of from 5.5 μm to 8 μm. If the toner has a weight-average particle diameter of more than 12 μm or contains 50% by volume or more of the particles of 10.1 μm or more in particle diameter, the charging performance may come non-uniform undesirably, and also it may be difficult to obtain highly minute images.

In the negatively chargeable toner of the present invention, the negatively chargeable toner may have an acid value of from 0.5 mg·KOH/g to 40 mg·KOH/g, preferably from 5 mg·KOH/g to 35 mg·KOH/g, and more preferably from 10 mg·KOH/g to 30 mg·KOH/g. Where the acid value of the negatively chargeable toner is within the above range, the state of dispersion of the vinyl copolymer in the toner particles is considered good, and the image density can be kept from decreasing even at the time of running.

Where in the negatively chargeable toner of the present invention the binder resin is a styrene polymer, a styrene copolymer or a mixture of these, the THF (tetrahydrofuran)-soluble matter of the binder resin and the vinyl copolymer may preferably have, in a chromatogram obtained by measurement by GPC (gel permeation chromatography), a main peak in the region of molecular weight of from 1,000 to 30,000 and a sub-peak in the region of molecular weight of 100,000 or more. It may more preferably have a main peak in the region of molecular weight of from 4,000 to 20,000 and a sub-peak in the region of molecular weight of from 200,000 to 1,500,000. It may still more preferably have a main peak in the region of molecular weight of from 6,000 to 15,000 and a sub-peak in the region of molecular weight of from 300,000 to 1,000,000. If it does not have any main peak in the region of molecular weight of from 1,000 to 30,000 or any sub-peak in the region of molecular weight of 100,000 or more, in either case it is difficult to disperse the vinyl copolymer in the negatively chargeable toner of the present invention in a favorable state, and, when a running test is conducted, image density tends to lower and fog density tends to increase, undesirably.

In the negatively chargeable toner of the present invention, a polyester resin may be used as the binder resin. In the case when the binder resin is the polyester resin, it may contain polyester in an amount of 50% by weight or more, preferably 60% by weight or more, and more preferably 70% by weight or more.

In the negatively chargeable toner of the present invention, in the case when the binder resin is the polyester resin, the polyester may also be present as a hybrid resin which is a reaction product with a vinyl polymer.

In the negatively chargeable toner of the present invention, in the case when the binder resin is the polyester resin, the THF-soluble matter of the binder resin and the vinyl copolymer may preferably have, in a chromatogram obtained by measurement by GPC, a main peak in the region of molecular weight of from 1,000 to 20,000, contain from 5% by weight to 30% by weight of a component having a molecular weight of from 100,000 or more to less than 10,000,000, and contain from 10% by weight to 30% by weight of a component having a molecular weight of from 1,000 or more to less than 5,000. It may more preferably have a main peak in the region of molecular weight of from 4,000 to 15,000, contain from 7% by weight to 27% by weight of the component having a molecular weight of from 100,000 or more to less than 10,000,000, and contain from 12% by weight to 28% by weight of the component having a molecular weight of from 1,000 or more to less than 5,000. It may still more preferably have a main peak in the region of molecular weight of from 6,000 to 15,000, contain from 10% by weight to 25% by weight of the component having a molecular weight of from 100,000 or more to less than 10,000,000, and contain from 15% by weight to 25% by weight of the component having a molecular weight of from 1,000 or more to less than 5,000. If it does not have any main peak in the region of molecular weight of from 1,000 to 20,000, or does not contain from 5% by weight to 30% by weight of the component having a molecular weight of from 100,000 or more to less than 10,000,000, or does not contain from 10% by weight to 30% by weight of the component having a molecular weight of from 1,000 or more to less than 5,000, in any of the cases it is difficult to hold in a favorable range the state of phase separation of the vinyl copolymer contained in the negatively chargeable toner of the present invention, and image density may decrease as a result of running, undesirably.

In the negatively chargeable toner of the present invention, the binder resin may preferably contain THF-insoluble matter in an amount of from 1% by weight to 60% by weight, more preferably from 5% by weight to 50% by weight, and still more preferably from 10% by weight to 40% by weight. If the THF-insoluble matter contained in the binder resin of the negatively chargeable toner is less than 1% by weight, the negatively chargeable toner tends to have poor high-temperature anti-offset properties. If on the other hand it is more than 60% by weight, the negatively chargeable toner tends to have poor low-temperature fixing performance. Also, in either of the case in which it is less than 1% by weight and the case in which it is more than 60% by weight, it is difficult to control the dispersion of the vinyl copolymer and that of wax, undesirably.

In the negatively chargeable toner of the present invention, the vinyl copolymer may also be used in combination with any of known different charge control agents like those stated in the related background art. For example, such different charge control agents may include organometallic complexes, metal salts and chelate compounds. Stated specifically, they may include monoazo metal complexes, acetylacetone metal complexes, hydroxycarboxylic acid metal complexes, polycarboxylic acid metal complexes and polyol metal complexes. Besides these, they may include metal salts of carboxylic acid, carboxylic acid anhydrides, carboxylic acid derivatives such as carboxylates, condensation products of aromatic compounds, and phenol derivatives such as bisphenols and carixarene.

In the negatively chargeable toner of the present invention, a charge control agent preferably usable together with the vinyl copolymer includes organoaluminum compounds, which are compounds formed by the reaction of any of aromatic diols, aromatic hydroxycarboxylic acids, aromatic monocarboxylic acids and aromatic polycarboxylic acids with aluminum compounds, as exemplified by organoaluminum complex compounds (complexes or complex salts) or organoaluminum salts. Preferred is an organoaluminum compound comprised of 2 mols of 3,5-di-tertiary-butylsalicylic acid and 1 mol of aluminum atom. Such organoaluminum compound may preferably be contained in the negatively chargeable toner in an amount of from 0.02% by weight to 2% by weight, more preferably from 0.05% by weight to 1.5% by weight, and still more preferably from 0.1% by weight to 1% by weight, as aluminum element. If the organoaluminum compound contained in the negatively chargeable toner is in an amount of less than 0.02% by weight, not only the negatively chargeable toner tends to have low high-temperature anti-offset properties, but also the negatively chargeable toner may adhere to the fixing member, and, if on the other hand it is in an amount of more than 2% by weight, the negatively chargeable toner may have low low-temperature fixing performance, undesirably.

In the negatively chargeable toner of the present invention, where the binder resin has an acid value, such a case is preferable in that, in the course of production of the negatively chargeable toner, the organoaluminum compound can effect a sort of complexing reaction (hereinafter "complexing reaction with aluminum") which is presumed to be the exchange reaction between the carboxyl group of the binder resin and the ligand. This enables achievement of the state of dispersion of the vinyl copolymer and the state of dispersion of wax which are suited for the negatively chargeable toner of the present invention. In this case, the organoaluminum compound is presumed not to exist as an aluminum complex or complex salt coordinated with an aromatic diol, an aromatic hydroxycarboxylic acid or an aromatic carboxylic acid.

In the negatively chargeable toner of the present invention, an organoiron compound may also be added as a charge control agent other than the organoaluminum compound used preferably.

As the organoiron compound, it may be a compound formed by the reaction of a monoazo compound represented by any of the following formulas (4) to (7) with an iron compound. Such an organoiron compound may preferably be contained in the negatively chargeable toner in an amount of from 0.02% by weight to 2% by weight, more preferably from 0.05% by weight to 1.5% by weight, and still more preferably from 0.1% by weight to 1% by weight, as iron element. If the organoiron compound contained in the negatively chargeable toner is in an amount of less than 0.02% by weight, a problem may arise in respect of the image density stability of the negatively chargeable toner in a high-temperature and high-humidity environment, and, if it is in an amount of more than 2% by weight, a problem may arise in respect of the image density stability of the negatively chargeable toner in a normal-temperature and low-humidity environment, undesirably.

(4)

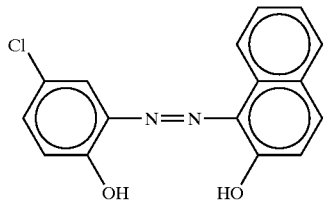

(5)

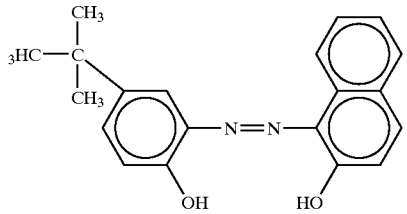

(6)

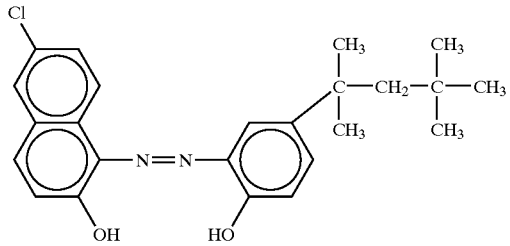

(7)

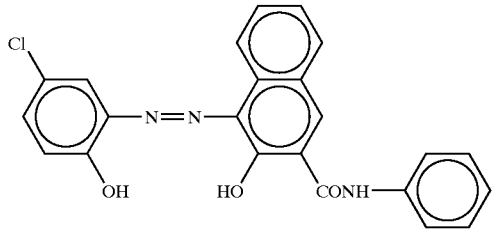

In the negatively chargeable toner of the present invention, a wax may be contained.

The wax to be contained in the negatively chargeable toner of the present invention may preferably have, in its molecular weight distribution as measured by GPC, a main peak (Mp) in the region of molecular weight of from 500 to 20,000 and a ratio Mw/Mn (weight-average molecular weight/number-average molecular weight) of from 1.2 to 20, more preferably a main peak (Mp) in the region of molecular weight of from 800 to 15,000 and a ratio Mw/Mn of from 1.3 to 18, and still more preferably a main peak (Mp) in the region of molecular weight of from 900 to 10,000 and a ratio Mw/Mn of from 1.4 to 10. If it has the Mp in the region of molecular weight of less than 500 or a ratio Mw/Mn of less than 1.2, the wax may have too small dispersion particle diameter in the negatively chargeable toner particles. If it has the Mp in the region of molecular weight of more than 20,000 or a ratio Mw/Mn of more than 20, the wax may have too large dispersion particle diameter. In either case, it is difficult to control the dispersion particle diameter of the wax, undesirably.

The wax to be contained in the negatively chargeable toner of the present invention may include paraffin wax, polyolefin wax, microcrystalline wax, Fischer-Tropsch wax such as polymethylene wax, amide waxes, higher fatty acids, long-chain alcohols, ester waxes, ketone waxes and derivatives thereof such as graft compounds and block compounds. These may preferably be those from which low-molecular-weight components have been removed and having a sharp maximum endothermic peak in the DSC endothermic curve.

As waxes preferably usable, the wax may further include low-molecular-weight alkylene polymers obtained by radical polymerization of alkylenes under a high pressure or polymerization thereof in the presence of a Ziegler catalyst or any other catalyst under a low pressure; alkylene polymers obtained by thermal decomposition of high-molecular-weight alkylene polymers; those obtained by separation and purification of low-molecular-weight alkylene polymers formed as by-products when alkylenes are polymerized; and polymethylene waxes obtained by extraction fractionation of specific components from distillation residues of hydrocarbon polymers obtained by the Arge process from a synthetic gas comprised of carbon monoxide and hydrogen, or from synthetic hydrocarbons obtained by hydrogenation of distillation residues. Antioxidants may be added to these waxes.

The negatively chargeable toner of the present invention may preferably have an endothermic main peak in the region of temperature of from 70° C. to 140° C. in the DSC curve measured with a differential scanning calorimeter (DSC) by differential thermal analysis of the negatively chargeable toner containing the wax. More preferred is a case in which it has the endothermic main peak in the region of temperature of from 75° C. to 135° C. Still more preferred is a case in which it has the endothermic main peak in the region of temperature of from 80° C. to 130° C. and at the same time has an endothermic sub-peak or an endothermic shoulder. If it has the endothermic main peak in the temperature region outside the foregoing, it is difficult for the toner to satisfy all the low-temperature fixing performance, anti-hot-offset properties and anti-blocking properties.

In the negatively chargeable toner of the present invention, the wax may be added to and dispersed in the negatively chargeable toner together with other components in the step of kneading. Preferably, the wax may be added after the binder resin has been dissolved in an organic solvent such as xylene. In such a case, the wax can much better be dispersed.

Where, in the negatively chargeable toner of the present invention, two or more kinds of different waxes are incorporated, a hydrocarbon wax, a polyethylene polymer, a polypropylene polymer, an acid-modified polyethylene having an acid value of from 1 to 20 mg·KOH/g or an acid-modified polypropylene having an acid value of from 1 to 20 mg·KOH/g may preferably be used at least as one of the waxes to be incorporated.

The negatively chargeable toner of the present invention may have a glass transition temperature (Tg) of from 45° C. to 75° C., and preferably from 50° C. to 70° C., from the viewpoint of toner's storage stability. If it has a Tg lower than 45° C., the toner tends to deteriorate in an atmosphere of high temperature, and also tends to cause offset at the time of fixing. If it has a Tg higher than 75° C., its fixing performance tends to lower, undesirably.

In the negatively chargeable toner of the present invention, monomers used in the case when a styrene polymer, a styrene copolymer or a mixture of these is used as the binder resin may include the following.

Comonomers copolymerizable with styrene monomers in styrene copolymers as the binder resin may include styrene derivatives such as vinyl toluene; acrylic acid and acrylates such as methyl acrylate, ethyl acrylate, butyl acrylate, dodecyl acrylate, octyl acrylate, 2-ethylhexyl acrylate and phenyl acrylate; methacrylic acid and methacrylates such as methyl methacrylate, ethyl methacrylate, butyl methacrylate, dodecyl methacrylate, octyl methacrylate, 2-ethylhexyl methacrylate and phenyl methacrylate; dicarboxylic acids having a double bond, such as maleic acid, maleic anhydride, monobutyl maleate, methyl maleate and dimethyl maleate; monomers such as acrylamide, methacrylamide, acrylonitrile, methacrylonitrile, butadiene, vinyl chloride, vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination of two or more.

In producing the binder resin styrene polymer or styrene copolymer, it may preferably be produced using a polyfunctional polymerization initiator alone or in combination with a monofunctional polymerization initiator which are as exemplified below.

As specific examples of a polyfunctional polymerization initiator having a polyfunctional structure, it may include polyfunctional polymerization initiators having in one molecule two or more functional groups such as peroxide groups, as exemplified by 1,1-di-tert-butylperoxy-3,3,5-trimethylcyclohexane, 1,3-bis(tert-butylperoxyisopropyl) benzene, 2,5-dimethyl-2,5-(tert-butylperoxy)hexane, tris-(tert-butylperoxy)triazine, 1,1-di-tert-butylperoxycyclohexane, 2,2-di-tert-butylperoxyvaleric acid-n-butyl ester, di-tert-butylperoxyhexahydroterephthalate, di-tert-butylperoxyazelate, di-tert-butyl-peroxytrimethyladipate, 2,2-bis(4,4-di-tert-butylperoxyhexycyclohexyl)propane, 1,1-di-tert-butylperoxy-3,3,5-trimethylcyclohexane and 2,2-bis-tert-butylperoxyoctane; and polyfunctional polymerization initiators having in one molecule both a peroxide group and a polymerizable unsaturated group, as exemplified by diallyl peroxydicarbonate, tert-butyl peroxymaleate, tert-butyl peroxyallyl carbonate, and tert-butyl peroxyisopropyl fumarate.

Of the above polymerization initiators, more preferred ones are 1,1-di-tert-butylperoxy-3,3,5-trimethylcyclohexane, 1,1-di-tert-butylperoxycyclohexane, di-tert-butylperoxyhexahydroterephthalate, di-tert-butylperoxyazelate and 2,2-bis(4,4-di-tert-butylperoxyhexycyclohexyl)propane.

In order to satisfy various performances required as binder resins for the negatively chargeable toner, any of these polyfunctional polymerization initiators may preferably be used in combination with a monofunctional polymerization initiator. In particular, they may preferably be used in combination with a polymerization initiator having a 10-hour half-life temperature which is lower than the decomposition temperature necessary for the polyfunctional polymerization initiator to obtain a half-life of 10 hours (10-hour half-life temperature), stated specifically, in combination with an organic peroxide such as benzoyl peroxide, lauroyl peroxide, dicumyl peroxide, tert-butylperoxycumene or di-tert-butyl peroxide.

Any of these monofunctional polymerization initiators may be added in the monomers at the same time the polyfunctional polymerization initiator is added. In order to keep a proper efficiency of the polyfunctional polymerization initiator, the monofunctional polymerization initiator may preferably be added after the half-life the polyfunctional polymerization initiator shows has lapsed in the polymerization step.

In the negatively chargeable toner of the present invention, monomers use when polyester is used as the binder resin may include the following.

As an alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A) and a diol represented by the following Formula (B).

Formula (A)

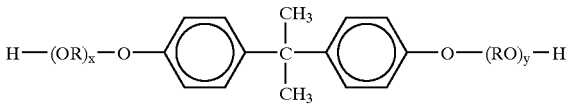

wherein R represents an ethylene group or a propylene group, x and y are each an integer of 1 or more, and an average value of x+y is 2 to 10;

Formula (B)

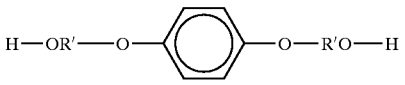

wherein R' represents

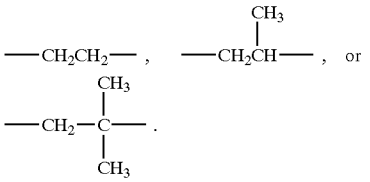

As an acid component, it may include aromatic dicarboxylic acids and anhydrides thereof, such as phthalic acid, isophthalic acid and terephthalic acid, and anhydrides thereof; alkyldicarboxylic acids such as succinic acid, adipic acid, sebacic acid and azelaic acid, and anhydrides thereof; and succinic acid substituted with an alkyl group having 6 to 12 carbon atoms, or anhydrides thereof; and unsaturated dicarboxylic acids such as fumaric acid, maleic acid and citraconic acid, or anhydrides thereof.

In the negatively chargeable toner of the present invention, the toner may preferably have, in its dielectric dissipation factor (tan δ) measured at a frequency of 100 kHz, a maximum value of from $2.5\times10^{-2}$ to $10.0\times10^{-2}$, more preferably from $3.0\times10^{-2}$ to $9.0\times10^{-2}$, and still more preferably from $4.0\times10^{-2}$ to $8.0\times10^{-2}$, in the range of temperature of from 100° C. to 130° C. If the maximum value of dielectric dissipation factor (tan δ) of the negatively chargeable toner is less than $2.5\times10^{-2}$, fog may greatly appear, and, if the maximum value of dielectric dissipation factor (tan δ) of the negatively chargeable toner is more than $10.0\times10^{-2}$, image density may remarkably lower in a high-temperature and high-humidity environment, undesirably.

The negatively chargeable toner of the present invention may be incorporated with a magnetic material so as to be used as a magnetic negatively chargeable toner. In such a case, the magnetic material may serve also as a colorant.

As the magnetic material used in the present invention, a magnetic iron oxide such as magnetite, maghematite or ferrite which contains a heterogeneous element and a mixture thereof may preferably be used.

For example, preferred is a magnetic iron oxide containing at least one element selected from lithium, beryllium, boron, magnesium, aluminum, silicon, phosphorus, sulfur, germanium, titanium, zirconium, tin, lead, zinc, calcium, barium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium, bismuth and so forth. In particular, lithium, beryllium, boron, magnesium, aluminum, silicon, phosphorus, germanium, titanium, zirconium, tin, sulfur, calcium, barium, vanadium, chromium, manganese, cobalt, copper, nickel, strontium, bismuth and zinc are preferred. Particularly preferred is a magnetic iron oxide containing as a heterogeneous element an element selected from magnesium, aluminum, silicon, phosphorus and zirconium. Any of these elements may be incorporated in iron oxide crystal lattices, or may be incorporated in iron oxide as an oxide, or may be present as an oxide or a hydroxide at the surface. It is preferable for it to be incorporated as an oxide.

Any of these elements may be incorporated in particles by making a salt of each element mingle and making pH adjustment, at the time of forming the magnetic material. It may also be deposited on particle surfaces by making pH adjustment after magnetic material particles have been formed, or by adding a salt of each element and making pH adjustment.

The magnetic material containing any of these elements commonly has a good affinity for binder resins of negatively chargeable toners, and, in the binder resin having a specific acid value, not only is more effective but also has favorable influence where the charge control resin used in the present invention is to be dispersed in a state favorable for the present invention. These magnetic materials also have narrow particle size distribution and are well dispersible in the binder resin, and hence have the effect of bringing improvement in making uniform and stable the charge of the negatively chargeable toner.

Any of these heterogeneous elements may preferably be in a content of from 0.05% by weight to 10% by weight, more preferably from 0.1% by weight to 7% by weight, and particularly preferably from 0.2% by weight to 5% by weight, based on the weight of the iron element of the magnetic iron oxide. If it is in a content of less than 0.05% by weight, the effect of incorporating these elements is not obtainable to make any good dispersibility and charge uniformity not achievable. If it is in a content of more than 10% by weight, electric charges may be released in a large quantity to cause a lack of charge, resulting in a decrease in image density or an increase in fog.

Any of these heterogeneous elements may preferably be, in its/their incorporation distribution, present in a larger quantity at the part near to particle surfaces of the magnetic material. For example, where the iron element of the iron oxide stands dissolved in a percentage of 20% (dissolution percentage), the heterogeneous element may preferably stand dissolved in a percentage of from 20% to 100%, more preferably 25% to 100%, particularly preferably 30% to 100% of the quantity in which the whole heterogeneous element(s) is/are present. Making the heterogeneous element present at the surface in a larger quantity enables more improvement in dispersion effect and electrical diffusion effect.

These magnetic materials may preferably be those having a number-average particle diameter of from 0.05 μm to 1.0 μm, and more preferably from 0.1 μm to 0.5 μm. Magnetic materials having a BET specific surface area of from 2 $m^2/g$ to 40 $m^2/g$ may preferably be used (more preferably from 4 $m^2/g$ to 20 $m^2/g$). There are no particular limitations on their particle shape, and those having any desired shape may be used. As magnetic properties, preferably used are those having a saturation magnetization of from 10 $Am^2/g$ to 200 $Am^2/kg$ (more preferably from 70 $Am^2/g$ to 100 $Am^2/kg$), a residual magnetization of from 1 to 100 $Am^2/kg$ (more preferably from 2 $Am^2/g$ to 20 $Am^2/kg$) and a coercive force of from 1 kA/m to 30 kA/m (more preferably from 2 kA/m to 15 kA/m) under application of a magnetic field of 795.8 kA/m. Any of these magnetic materials may be used in an amount of from 20 parts by weight to 200 parts by weight based on 100 parts by weight of the binder resin.

As colorants usable in the negatively chargeable toner of the present invention, besides the above magnetic materials, any suitable pigments and dyes may be used. For example, the pigments include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining optical density of fixed images, and may be added in an amount of from 0.1 part by weight to 20 parts by weight, and preferably from 0.2 part by weight to 10 parts by weight, based on 100 parts by weight of the binder resin. The dyes may also be used for the same purpose, and include, e.g., azo dyes, anthraquinone dyes, xanthene dyes and methine dyes, any of which may be added in an amount of from 0.1 part by weight to 20 parts by weight, and preferably from 0.3 part by weight to 10 parts by weight, based on 100 parts by weight of the binder resin.

In the negatively chargeable toner of the present invention, an inorganic oxide such as silica, alumina, titanium oxide or a compound oxide of any of these may externally be added as an inorganic fine powder.

A fine silica powder, a fine alumina powder or a fine titanium oxide powder may preferably be finer particles because the effect of providing fluidity to the negatively chargeable toner can be higher when dispersed on negatively chargeable toner particle surfaces, and may preferably have a number-average particle diameter of from 5 nm to 100 nm, and more preferably from 5 nm to 50 nm.

Such an inorganic fine powder may be added in an amount of from 0.03 part by weight to 5 parts by weight, based on 100 parts by weight of the negatively chargeable toner particles. This brings the negatively chargeable toner particles into an appropriate state of surface coating.

In particular, preferred one is fine powder produced by vapor phase oxidation of a silicon halide, which is what is called dry-process silica or fumed silica. For example, it is produced utilizing heat decomposition oxidation reaction in oxyhydrogen flame of silicon tetrachloride gas. The reaction basically proceeds as follows:

$$SiCl_4+2H_2+O_2 \rightarrow SiO_2+4HCl$$

In this production step, it is also possible to use other metal halide such as aluminum chloride or titanium chloride together with the silicon halide to obtain a composite fine powder of silica with other metal oxide.

Commercially available fine silica powders produced by the vapor phase oxidation of silicon halides include, e.g., those which are on the market under the following trade names: AEROSIL 130, 200, 300, 380, TT600, MOX170, MOX80, COK84 (Aerosil Japan, Ltd.); Ca—O—SiL M-5, MS-7, MS-75, HS-5, EH-5 (Cabot Corp); WACKER HDK N20, 15, N20E, T30, T40 (Wacker-Chemie GmbH); D-C FINE SILICA (Dow-Corning Corp.); and FRANSOL (Franzil Co.).

It is also preferable for the fine silica powder to have been made hydrophobic. As methods for making hydrophobic, for example the fine silica powder may be made hydrophobic by chemical treatment with an organosilicon compound capable of reacting with or physically adsorbing the fine silica powder. In particular, it is preferable for the fine silica powder to have been treated with silicone oil. More preferred is a method in which the fine silica powder is treated with a silane coupling agent and thereafter, or at the same time it is treated with the silane coupling agent, treated with silicone oil.

As the silicone oil, one having a viscosity at 25° C. of from 30 $mm^2/s$ to 1,000 $mm^2/s$ may be used. Stated specifically, dimethylsilicone oil, methylphenylsilicone oil, α-methylstyrene-modified silicone oil, chlorophenylsilicone oil and fluorine-modified silicone oil are preferred, and dimethylsilicone oil is particularly preferred. Fine silica powder having been hydrophobic-treated with dimethylsilicone oil has appropriate hydrophobicity, and hence can effectively prevent the charge quantity of toner from lowering because of moisture absorption and the developing performance of toner from lowering. Thus, especially when it is used in combination with the toner of the present invention, having superior chargeability, it can more effectively exhibit the effect of moisture resistance to achieve an improvement in developing performance.

The silane coupling agent may include hexamethyldisilazane, trimethylsilane, trimethylchlorosilane, trimethylethoxysilane, butyltrimethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltri-chlorosilane, β-chloroethyltrichlorosilane, chloromethyldimethylchlorosilane, triorganosilyl mercaptan, tirmethylsilyl mercaptan, triorganosilyl acrylate, vinyldimethylacetoxysilane, vinyltriethoxysilane, vinyltriacetoxysilane, divinylchlorosilane, dimethylethoxysilane, dimethyldimethoxysilane, diphenyldiethoxysilane, γ-methacryloxypropyltrimethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and having a hydroxyl group bonded to each Si in its units positioned at the terminals. Any of these may be used alone or in the form of a mixture of two or more.

As the inorganic fine powder, serving as a fluidity improver, one having a specific surface area of 30 $m^2/g$ or more, and preferably 50 $m^2/g$ or more, as measured by the BET method utilizing nitrogen absorption provides good results. The fluidity improver may preferably be used in an amount of from 0.01 part by weight to 8 parts by weight, and preferably from 0.1 part by weight to 4 parts by weight, based on 100 parts by weight of the negatively chargeable toner.

The inorganic fine powder used in the present invention may preferably have a degree of hydrophobicity showing a value of 30% or more, and more preferably 50% or more, as methanol wettability.

In the present invention, in addition to the above inorganic oxide, other additives may be used for the purpose of providing various properties. For example, they may include the following.

(1) Abrasives: Metal oxides (e.g., cerium oxide, aluminum oxide, magnesium oxide and chromium oxide), nitrides (e.g., silicon nitride), carbides (e.g., silicon carbide), metal salts (e.g., strontium titanate, calcium sulfate, barium sulfate and calcium carbonate) and the like.
(2) Lubricants: Fluorine resin powders (e.g., vinylidene fluoride and polytetrafluoroethylene), fatty acid metal salts (e.g., zinc stearate and calcium stearate) and the like.
(3) Charge controlling particles: Metal oxides (e.g., tin oxide, titanium oxide, zinc oxide, silicon oxide and aluminum oxide), carbon black, fine resin particles and the like.

Any of these additives may be used in an amount of from 0.05 part by weight to 10 parts by weight, and preferably from 0.1 part by weight to 5 parts by weight, based on 100 parts by weight of the negatively chargeable toner particles. These additives may be used alone or in combination of two or more.

In the case of the magnetic negatively chargeable toner, for achieving running stability of development and development stability after leaving, it is preferable to use two or more kinds of inorganic fine powders. In the case of a non-magnetic one-component developing system, for improving fluidity and achieving image uniformity, it is preferable to use titanium oxide or alumina.

The negatively chargeable toner of the present invention may be blended with a carrier so as to be used as a two-component developer. The carrier may preferably be made to have an electrical resistance of from $10^6$ Ω·cm to $10^{10}$ Ω·cm by controlling the degree of unevenness of carrier particle surfaces and the quantity of a resin with which the carrier particle surfaces are to be coated.

As the resin with which the carrier particle surfaces are to be coated, usable are a styrene-acrylate copolymer, a styrene-methacrylate copolymer, other acrylate copolymers and methacrylate copolymers, silicone resins, fluorine-containing resins, polyamide resins, ionomer resins, polyphenylene sulfide resins, or mixtures of any of these.

As a magnetic material of carrier cores, usable are oxides such as ferrite, iron-excess type ferrite, magnetite and γ-iron oxide, metals such as iron, cobalt and nickel, or alloys of any of these. An element or elements contained in these magnetic materials may also include iron, cobalt, nickel, aluminum, copper, lead, magnesium, tin, zinc, antimony, beryllium, bismuth, calcium, manganese, selenium, titanium, tungsten and vanadium.

Methods for producing the negatively chargeable toner of the present invention include a polymerization toner production method in which stated materials are mixed with monomers which are to constitute the binder resin, to prepare an emulsion suspension, followed by polymerization to obtain toner particles; a method in which, in what is called a microcapsule toner comprised of a core material and a shell material, the core material or the shell material, or both of them, is/are incorporated with stated materials; a method in which constituent materials are dispersed in a binder resin solution, followed by spray drying to obtain toner particles; and a method in which toner constituent materials are thoroughly mixed by means of a ball mill or other mixing machine, thereafter the mixture obtained is well kneaded by means of a heat kneading machine such as a heat roll kneader or an extruder and the kneaded product obtained is cooled to solidify, followed by mechanical pulverization and then classification of the pulverized product to obtain toner particles. Any desired additives and the toner particles may further optionally thoroughly be mixed by means of a mixing machine such as a Henschel mixer to produce the negatively chargeable toner of the present invention.

Image-forming methods to which the negatively chargeable toner of the present invention is applicable are described below with reference to the accompanying drawings.

A two-component developing system is described first.

The negatively chargeable toner of the present invention may be blended with the magnetic carrier, and may be applied in an image-forming method, using, e.g., a developing means (developing assembly) 37 as shown in FIG. 1. Stated specifically, development may preferably be performed applying an alternating electric field and in such a state that a magnetic brush formed of the negatively chargeable toner and magnetic carrier comes into touch with an image-bearing member (e.g., photosensitive drum) 33. A distance B between a developer carrying member (developing sleeve) 31 and the photosensitive drum 33 (distance between S-D) may preferably be from 100 μm to 1,000 μm. This is desirable for preventing carrier adhesion and improving dot reproducibility. If it is smaller (i.e., the gap is narrower) than 100 μm, the developer tends to be insufficiently fed, resulting in a low image density. If it is larger than 1,000 μm, the magnetic line of force from a magnetic pole S1 may broaden to make the magnetic brush have a low density, resulting in a poor dot reproducibility, or to weaken the force of binding the carrier, tending to cause carrier adhesion. A negatively chargeable toner 41 for replenishing is successively fed to the developing assembly 37 and is blended with the carrier by agitation means 35 and 36. The toner and carrier thus blended are transported to the developing sleeve 31 holding a stationary magnet 34 internally.

The alternating electric field may preferably be applied at a peak-to-peak voltage (Vpp) of from 500 to 5,000 V and a frequency (f) of from 500 to 10,000 Hz, and preferably from 500 to 3,000 Hz, which may each be applied to the process under appropriate selection. In this case, the waveform used may be selected from triangular waveform, rectangular waveform, sinusoidal waveform, or waveform with a varied duty ratio. If the applied voltage is lower than 500 V, a sufficient image density may be attained with difficulty, and fog negatively chargeable toner at non-image areas can not well be collected in some cases. If it is higher than 5,000 V, the electrostatic latent image may be disordered through the magnetic brush to cause a lowering of image quality.

Use of a two-component developer having a negatively chargeable toner well charged enables application of a low fog take-off voltage (Vback), and enables the photosensitive member to be low charged in its primary charging, thus the photosensitive member can be made to have a longer lifetime. The Vback, which may depend on the development system, may preferably be 150 V or below, and more preferably 100 V or below.

As contrast potential, a potential of from 200 V to 500 V may preferably be used so that a sufficient image density can be achieved.

If the frequency (f) is lower than 500 Hz, electric charges may be injected into the carrier, relating also to the process speed, so that carrier adhesion may occur or latent images may be disordered to cause a lowering of image quality. If it is higher than 10,000 Hz, the toner can not follow up the electric field to tend to cause a lowering of image quality.

In order to perform development promising a sufficient image density, achieving a superior dot reproducibility and free of carrier adhesion, the magnetic brush on the developing sleeve 31 may preferably be made to come into touch with the photosensitive drum 33 at a width (developing nip C) of from 3 mm to 8 mm. If the developing nip C is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion. As methods for adjusting the developing nip, the nip width may appropriately be adjusted by adjusting the distance A between a developer-regulating blade 32 and the developing sleeve 31, or by adjusting the distance B between the developing sleeve 31 and the photosensitive drum 33.

In the formation of full-color images which attaches importance especially to halftones, three or more developing assemblies for magenta, cyan and yellow may be used, and the negatively chargeable toner of the present invention may be used, especially in combination with a development system in which digital latent images are formed. Thus, the latent images are not affected by the magnetic brush and are not disordered, and hence can be developed faithfully to the dot images. In the transfer step, too, the use of the negatively chargeable toner of the present invention enables achievement of a high transfer efficiency, and therefore enables achievement of a high image quality in both halftone areas and solid areas.

In addition, concurrently with achievement of a high image quality at the initial stage, the use of the negatively chargeable toner of the present invention can keep image quality from lowering even in many-sheet copying, and can well bring the effect of the present invention.

The negatively chargeable toner image held on the image-bearing member 33 is transferred onto a transfer material by a transfer means 43 such as a corona charging assembly. The negatively chargeable toner image thus held on the transfer material is fixed by a heat-and-pressure fixing means having a heating roller 46 and a pressure roller 45. Transfer residual negatively chargeable toner remaining on the image-bearing member 33 is removed from the surface of the image-bearing member 33 by a cleaning means 44 such as a cleaning blade. The negatively chargeable toner of the present invention has so high a transfer efficiency in the transfer step as to leave less transfer residual negatively chargeable toner, and also has superior cleaning performance. Hence, it may hardly cause the filming on the image-bearing member. Moreover, even when tested on many-sheet running, the external additives in the negatively chargeable toner of the present invention may less become buried in the negatively chargeable toner particle surfaces than those in any conventional negatively chargeable toners, and hence good image quality can be maintained over a long period of time.

In order to obtain good full-color images, an image-forming apparatus having developing assemblies for magenta, cyan, yellow and black which are so disposed that development for black is finally performed may be used, whereby images assuming a tightness can be obtained.

An example of an image-forming apparatus which can well carry out a multi-color or full-color image formation process is described below with reference to FIG. 2.

Figure 2:
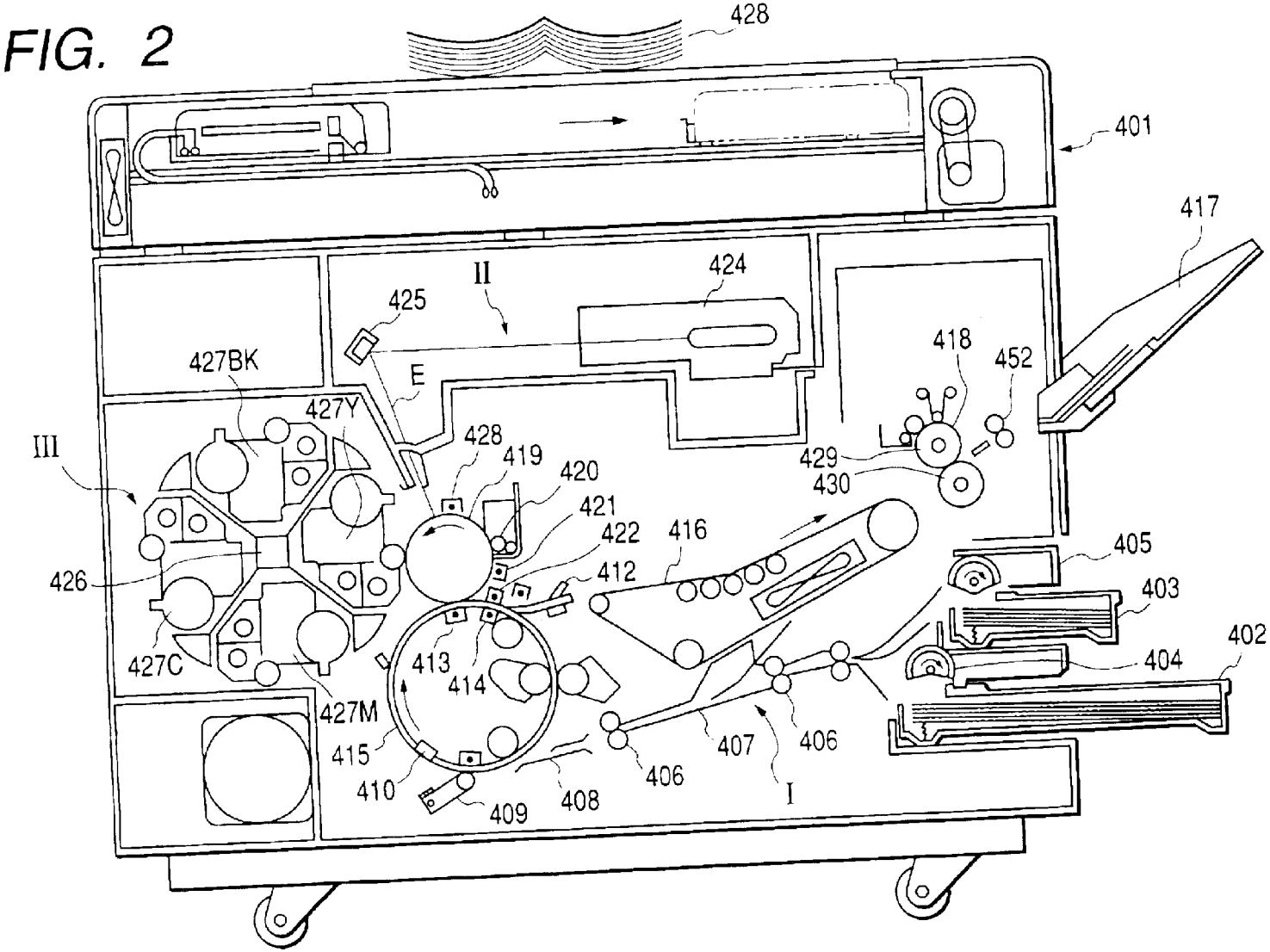
FIG. 2 is a schematic view for describing a full-color or multi-color image-forming method.

A color electrophotographic apparatus 401 illustrated in FIG. 2 is roughly grouped into a transfer material transport system I so provided as to extend from the right side (as viewed in FIG. 2) of the main body of the apparatus to substantially the middle of the main body of the apparatus, a latent image forming zone II provided in substantially the middle of the main body of the apparatus and in proximity to a transfer drum 415 constituting the transfer material transport system I, and a developing means (i.e., a rotary developing unit) III provided in proximity to the latent image forming zone II.

The above transfer material transport system I is constructed in the following way. Transfer material feeding trays 402 and 403 detachable through openings of the apparatus are provided in the manner that they partly extend toward the outside of the apparatus. Paper feed rollers 404 and 405 are provided almost directly above the trays 402 and 403, respectively, and another paper feed roller 406 and paper guides 407 and 408 are provided in the manner that the paper feed rollers 404 and 405 can be associated with the transfer drum 415 provided on the left side and rotatable in the direction of an arrow A. A contacting roller 409, a gripper 410, a transfer material separating corona assembly 422 and a separating claw 412 are sequentially provided in the vicinity of the periphery of the transfer drum 415 from the upstream side to the downstream side in the direction of its rotation.

A transfer corona assembly 413 and a transfer material separating corona assembly 414 are provided inside the periphery of the transfer drum 415. A transfer sheet (not shown) formed of a polymer such as polyvinylidene fluoride is stuck to the part where transfer materials on the transfer drum 415 wind around, and the transfer materials are electrostatically brought into close contact with the surface of the transfer sheet. A paper delivery belt means 416 is provided in proximity to the separating claw 412 at the right upper part of the transfer drum 415, and a fixing assembly 418 is provided at the terminal (the right side) of the transfer material transport direction of the paper delivery belt means 416. A paper output tray 417 extending to the outside of the main body 401 of the apparatus and detachable from the main body 401 thereof is provided more downstream in the transport direction than the fixing assembly 418.

The latent image forming zone II is constructed as described below. An image-bearing member photosensitive drum (e.g. an OPC photosensitive drum) 419 rotatable in the direction of an arrow in FIG. 2 is provided in the manner that its periphery comes into contact with the periphery of the transfer drum 415. Above the photosensitive drum 419 and in the vicinity of the periphery thereof, a residual charge eliminating corona assembly 421, a cleaning means 420 and a primary corona assembly 423 are sequentially provided from the upstream side to the down stream side in the direction of rotation of the photosensitive drum 419. An imagewise exposure means 424 such as a laser beam scanner to form an electrostatic latent image on the periphery of the photosensitive drum 419, and an imagewise exposing light reflecting means 425 such as a mirror are also provided.

The rotary developing unit III is constructed in the following way. It is provided with a rotatable housing (hereinafter "rotating support") 426 at the position facing the periphery of the photosensitive drum 419. In the rotating support 426, four kinds of developing assemblies are mounted and are so constructed that electrostatic latent images formed on the periphery of the photosensitive drum 419 can be converted into visible images (i.e., developed). The four kinds of developing assemblies comprise a yellow developing assembly 427Y, a magenta developing assembly 427M, a cyan developing assembly 427C and a black developing assembly 427BK, respectively.

The sequence of the whole image forming apparatus constructed as described above is described by giving an example of full-color mode image formation. With the rotation of the above photosensitive drum 419 in the direction of the arrow in FIG. 2, the photosensitive drum 419 is electrostatically charged by means of the primary corona assembly 423. In the apparatus shown in FIG. 2, the photosensitive drum 419 is operated at a peripheral speed (hereinafter "process speed") of 100 mm/sec or higher, e.g., 130 to 250 mm/sec. Upon the electrostatic charging on the photosensitive drum 419 by means of the primary corona assembly 423, imagewise exposure is effected using laser light E modulated by yellow image signals of an original 428, so that an electrostatic latent image is formed on the photosensitive drum 419, and then the electrostatic latent image is developed by means of the yellow developing assembly 427Y previously set stationary at a developing position by the rotation of the rotating support 426. Thus, a yellow toner image is formed.

The transfer material transported through the paper feed guide 407, paper feed roller 406 and paper feed guide 408 is held fast by the gripper 410 at a given timing, and is electrostatically wound around the transfer drum 415 by means of the contacting roller 409 and an electrode set opposingly to the contacting roller 409. The transfer drum 415 is rotated in the direction of the arrow in FIG. 2 in synchronization with the photosensitive drum 419. The yellow toner image formed by the development with the yellow developing assembly 427Y is transferred to the transfer material by means of the transfer corona assembly 413 at the portion where the periphery of the photosensitive drum 419 and the periphery of the transfer drum 415 come into contact with each other. The transfer drum 415 is continued rotating without stop, and stands ready for a next color (magenta as viewed in FIG. 2).

The photosensitive drum 419 is destaticized by means of the residual charge eliminating corona assembly 421, and is cleaned through the cleaning means 420. Thereafter, it is again electrostatically charged by means of the primary corona assembly 423, and is subjected to imagewise exposure according to the next magenta image signals, where an electrostatic latent image is formed. The above rotary developing unit is rotated while the electrostatic latent image is formed on the photosensitive drum 419 according to the magenta image signals as a result of the imagewise exposure, until the magenta developing assembly 427M is set stationary at the above given developing position, where the development is carried out using a stated magenta toner. Subsequently, the process as described above is also carried out on a cyan color and a black color each. After transfer steps corresponding to the four colors have been completed, three-color visible images formed on the transfer material are destaticized by the corona assemblies 422 and 414, and the transfer material held by the gripper 410 is released therefrom. At the same time, the transfer material is separated from the transfer drum 415 by means of the separating claw 412, and then delivered to the fixing assembly 418 over the delivery belt 416, where the images are fixed by the action of heat and pressure applied by a heating roller 429 and a pressure roller 430. Thus, the sequence of full-color print is completed and the desired full-color print image is formed on one side of the transfer material.

Another image-forming method is specifically described below with reference to FIG. 3.

Figure 3:
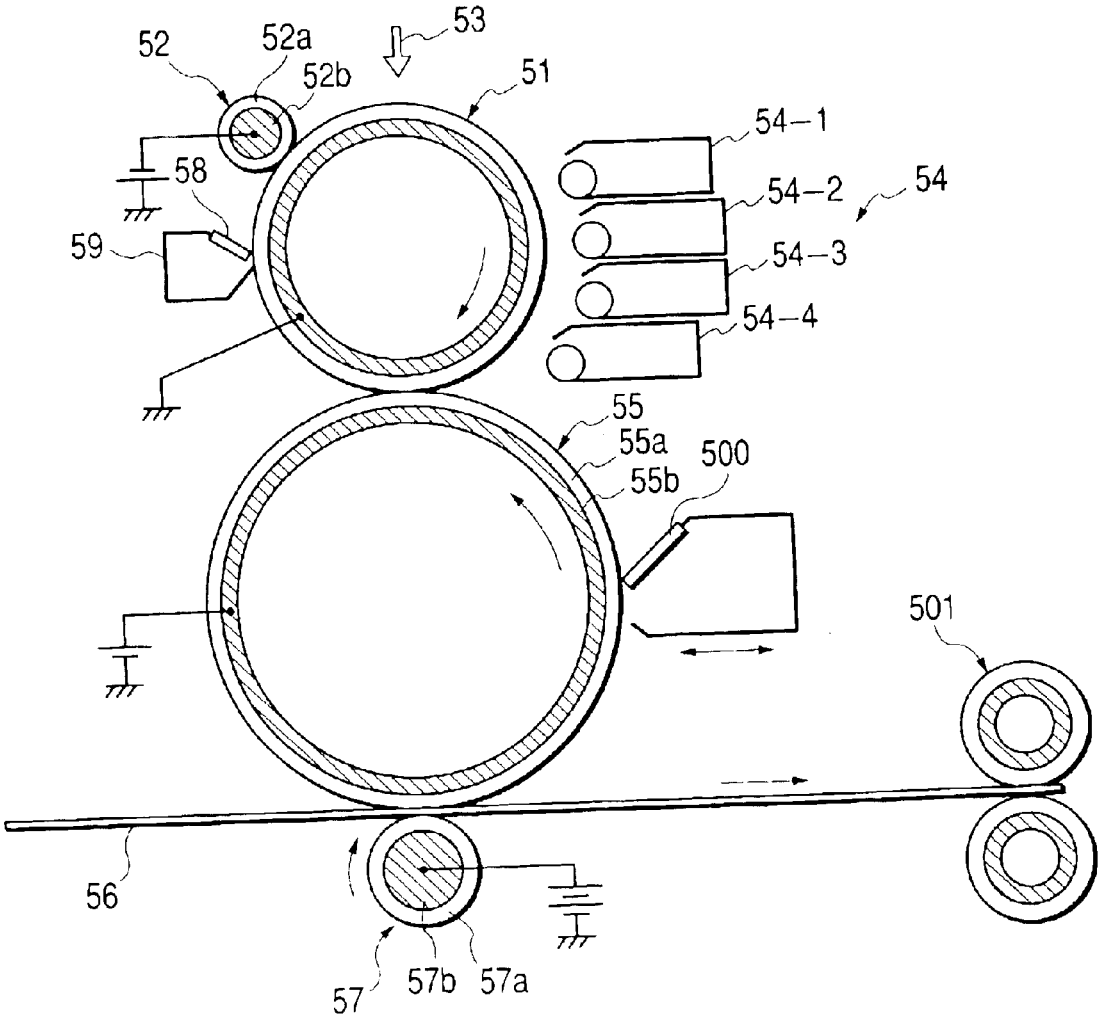
FIG. 3 is a schematic view for describing an image-forming method making use of an intermediate transfer member.

In the apparatus system shown in FIG. 3, a developer having a cyan toner, a developer having a magenta toner, a developer having a yellow toner and a developer having a black toner are put into developing assemblies 54-1, 54-2, 54-3 and 54-4, respectively. Electrostatic latent images formed on an image-bearing member (photosensitive member) 51 upon exposure are developed by a magnetic-brush developing system or a non-magnetic one-component developing system to form toner images of respective colors on the photosensitive member 51. The photosensitive member 51 is a photosensitive drum or photosensitive belt having a photoconductive insulating material layer formed of a-Se, CdS, $ZnO_2$, OPC or a-Si. The photosensitive member 51 is rotated by means of a drive system (not shown) in the direction of arrow.

As the photosensitive member 51, a photosensitive member having an amorphous silicon photosensitive layer or an organic photosensitive layer may preferably be used.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate and formed superposingly thereon the charge generation layer and the charge transport layer in this order is one of preferred examples.

As binder resins for the organic photosensitive layer, polycarbonate resins, polyester resins or acrylic resins are preferred especially because they contribute to a good transfer performance and cleaning performance, and may hardly cause faulty cleaning, melt-adhesion of negatively chargeable toner to the photosensitive member and filming of external additives.

The step of charging has a system making use of a corona charging assembly and being in non-contact with the photosensitive member 51, or a contact type system making use of a roller or the like. Either system may be used. The contact type system as shown in FIG. 3 may preferably be used so as to enable efficient and uniform charging, simplify the system and make ozone less occur.

A charging roller 52 is constituted basically of a mandrel 52*b* and a conductive elastic layer 52*a* that forms the periphery of the former. The charging roller 52 is brought into pressure contact with the surface of the photosensitive member 51 and is rotated followingly as the photosensitive member 51 is rotated.

When the charging roller is used, the charging may preferably be performed under process conditions of a roller contact pressure of 5 to 500 g/cm, and an AC voltage of 0.5 to 5 kVpp, an AC frequency of 50 Hz to 5 kHz and a DC voltage of ±0.2 to ±1.5 kV when a voltage formed by superimposing an AC voltage on a DC voltage, and a DC voltage of from ±0.2 to ±5 kV when a DC voltage is used.

As a charging means other than the charging roller, there is a method making use of a charging blade and a method making use of a conductive brush. These contact charging means have the effect of, e.g., making high voltage unnecessary and making ozone less occur.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

The negatively chargeable toner image on the photosensitive member 51 is transferred to an intermediate transfer member 55 to which a voltage (e.g., ±0.1 to ±5 kV) is kept applied. The surface of the photosensitive member 51 after transfer is cleaned by a cleaning means 59 having a cleaning blade 58.

The intermediate transfer member 55 is comprised of a pipe-like conductive mandrel 55*b* and a medium-resistance elastic material layer 55*a* formed on its periphery. The mandrel 55*b* may be formed of a plastic pipe provided thereon with a conductive coating.

The medium-resistance elastic material layer 55*a* is a solid or foamed-material layer made of an elastic material such as silicone rubber, polyfluoroethylene rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance value (volume resistivity) to a medium resistance of from $10^5$ to $10^{11}$ Ω·cm.

The intermediate transfer member 55 is provided in contact with the bottom part of the photosensitive member 51, being axially supported in parallel to the photosensitive member 51, and is driven rotatingly at the same peripheral speed as the photosensitive member 51 in the direction shown by an arrow.

The first-color negatively chargeable toner image formed and held on the surface of the photosensitive member 51 is, in the course where it is passed through the transfer nip portion where the photosensitive member 51 and the intermediate transfer member 55 come into contact, transferred intermediately sequencially to the periphery of the intermediate transfer member 55 by the aid of the electric filed formed at the transfer nip zone by a transfer bias applied to the intermediate transfer member 55.

If necessary, after the toner image has been transferred to the transfer medium, the surface of the intermediate transfer member 55 may be cleaned by a cleaning means 500 which can become contact with or separate from it. When the toner is present on the intermediate transfer member 55, the cleaning means 500 is separated from the surface of the intermediate transfer member so that the toner image is not disturbed.

A transfer means 57 is provided in contact with the bottom part of the intermediate transfer member 55, being axially supported in parallel to the intermediate transfer member 55. The transfer means 57 is, e.g., a transfer roller or a transfer belt, and is rotated at the same peripheral direction as the intermediate transfer member 55 in the clockwise direction as shown by an arrow. The transfer means 57 may be so provided that it comes into direct contact with the intermediate transfer member 55, or may be so disposed that a belt or the like comes into contact with, and between, the intermediate transfer member 55 and the transfer means 57.

In the case of the transfer roller, it is constituted basically of a mandrel 57*b* at the center and a conductive elastic layer 57*a* that forms the periphery of the former.

The intermediate transfer member and the transfer roller may be formed of commonly available materials. The elastic layer of the transfer roller may be made to have a volume resistivity set smaller than the volume resistivity of the elastic layer of the intermediate transfer member, whereby the voltage applied to the transfer roller can be lessened, good negatively chargeable toner images can be formed on the transfer medium 56 and also the transfer medium can be prevented from being wound around the intermediate transfer member. In particular, the elastic layer of the intermediate transfer member may preferably have a volume resistivity at least 10 times the volume resistivity of the elastic layer of the transfer roller.

The hardness of the intermediate transfer member and transfer roller is measured according to JIS K-6301. The intermediate transfer member used in the present invention may preferably be constituted of an elastic layer with a hardness in the range of from 10 to 40 degrees. As for the hardness of the transfer roller, the transfer roller may preferably have an elastic layer with a hardness higher than the hardness of the elastic layer of the intermediate transfer member and has a value of from 41 to 80 degrees, in order to prevent the transfer medium from being wound around the intermediate transfer member. If the intermediate transfer member and the transfer roller have a reverse hardness, a concave may be formed on the transfer roller side to tend to cause the transfer medium to wind around the intermediate transfer member.

The transfer means 57 is rotated at a speed equal to, or made different from, the peripheral speed of the intermediate transfer member 55. The transfer medium 56 is transported between the intermediate transfer member 55 and the transfer means 57 and simultaneously a bias with a polarity reverse to that of the triboelectric charge the toner has is applied to the transfer means 57 from a transfer bias applying means, so that the toner image on the intermediate transfer member 55 is transferred to the surface side of the transfer medium 56.

The transfer roller may be made of the same material as used in the charging roller. The transfer may preferably be performed under process conditions of a roller contact pressure of 5 to 500 g/cm and a DC voltage of ±0.2 to ±10 kV.

For example, a conductive elastic layer 57*b* of the transfer roller is made of an elastic material having a volume resistivity of about $10^6$ to $10^{10}$ Ω·cm, e.g., a polyurethane or an ethylene-propylene-diene type terpolymer (EPDM), with a conductive material such as carbon dispersed therein. A bias is kept applied to a mandrel 57*a* by a constant voltage power source. As bias conditions, a voltage of from ±0.2 to ±10 kV is preferred.

Subsequently, the transfer medium 56 is transported to a fixing assembly 501 constituted basically of a heat roller provided internally with a heating element such as a halogen heater and an elastic material pressure roller brought into contact therewith under pressure, and is passed between the heat roller and the pressure roller, thus the toner image is heat-and-pressure fixed to the transfer medium. Another method may also be used in which the toner image is fixed by a heater through a film.

A one-component developing method is described below. The negatively chargeable toner of the present invention may be applied in one-component developing systems such-as a magnetic one-component developing system and a non-magnetic one-component developing system. The magnetic one-component developing system is described below with reference to FIG. 4.

Figure 4:
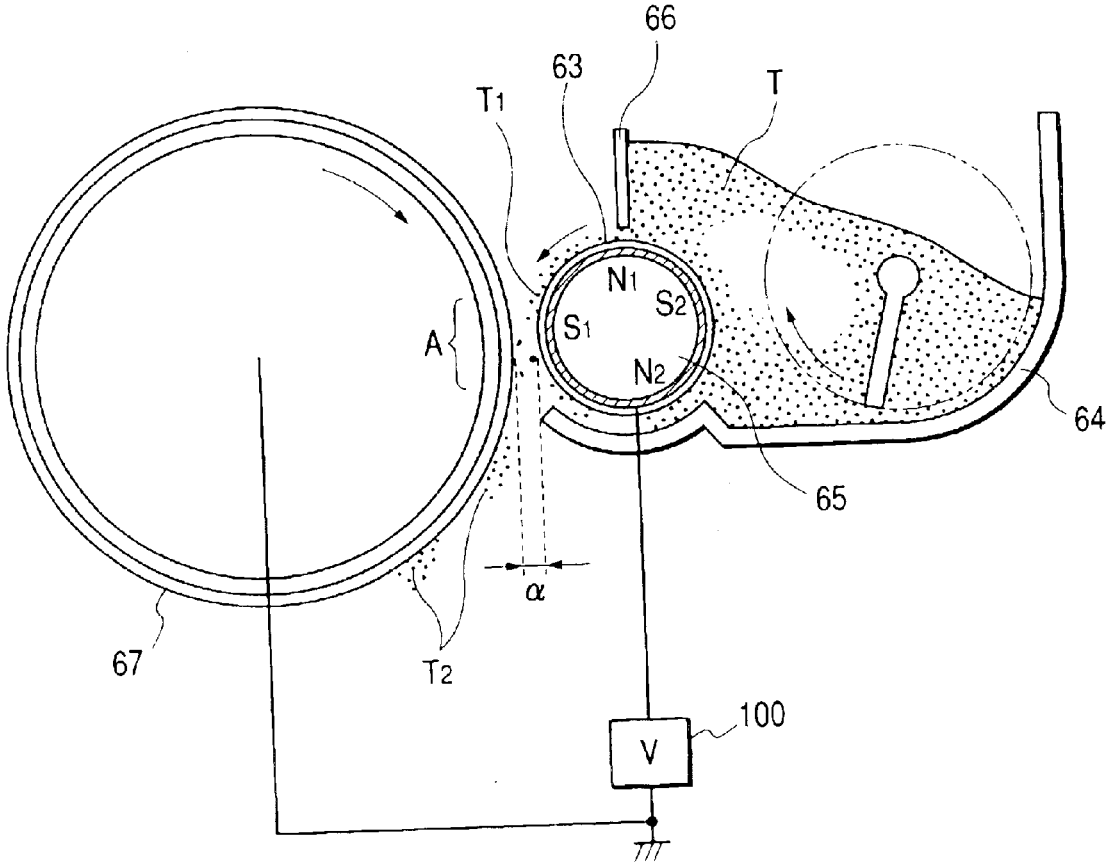
FIG. 4 is a schematic view showing a magnetic one-component developing unit.

As shown in FIG. 4, substantially the right-half periphery of a developer-carrying member (developing sleeve) 63 always comes in contact with the toner stock inside a toner container 64. A magnetic toner T held in the vicinity of the surface of the developing sleeve 63 is attracted to and carried on the surface of the developing sleeve by the action of magnetic force and/or electrostatic force, the former being produced by a magnetism generating means 65 provided in the developing sleeve. As the developing sleeve 63 is rotatingly driven, the magnetic-toner layer formed on the surface of the sleeve passes the position of a regulation member 66, in the course of which the toner is formed into a regulated layer as a thin-layer magnetic toner T1 with a uniform thickness at every portion. The magnetic toner is electrostatically charged chiefly by the frictional contact with the sleeve surface as the developing sleeve 63 is rotated. As the developing sleeve 63 is rotated, the thin-layer surface of the magnetic toner carried on the developing sleeve 63 is rotatingly moved toward the side of an image-bearing member 67 and is passed through a developing zone A at which the image-bearing member 67 and the developing sleeve 63 come nearest. In the course of passing the developing zone A, the magnetic toner of the magnetic toner thin layer formed on the developing sleeve 63 flies by the aid of DC and AC electric fields formed by direct current and alternating current voltages applied across the image-bearing member 67 and the developing sleeve 63 by a voltage applying means 100, and reciprocates (at a gap $\alpha$) between the surface of the image-bearing member 67 and the surface of the developing sleeve 63 at the developing zone A. Finally, the magnetic toner on the side of the developing sleeve 63 is selectively transferred and attracted to the surface of the image-bearing member 67 in accordance with potential patterns of electrostatic latent images, so that magnetic toner images T2 are successively formed.

The surface of the developing sleeve 63, having passed the developing zone A and from which the magnetic toner has selectively been consumed, is returned to the toner stock in the toner container 64, so that it is again supplied with the magnetic toner and the magnetic toner thin layer T1 carried on the developing sleeve 63 is transported to the developing zone A. In this way, the step of development is repeated.

The regulation member 66 serving as a toner thin-layer forming means used in the assembly shown in FIG. 4 is a doctor blade such as a metallic blade or a magnetic blade, provided leaving a certain gap between it and the developing sleeve 63. Alternatively, in place of the doctor blade, a roller formed of metal, resin or ceramic may be used. Also, as the toner thin-layer forming regulation member, an elastic blade or elastic roller may also be used which elastically comes into touch with the surface of the developing sleeve by elastic force.

As materials for forming the elastic blade or elastic roller, it is possible to use rubber elastic materials such as silicone rubber, urethane rubber and NBR; synthetic resin elastic materials such as polyethylene terephthalate, or metal elastic materials such as stainless steel, steel and phosphor bronze, as well as composite materials thereof. The part coming into touch with the sleeve may preferably be made of the rubber elastic material or resin elastic material.

Figure 5:
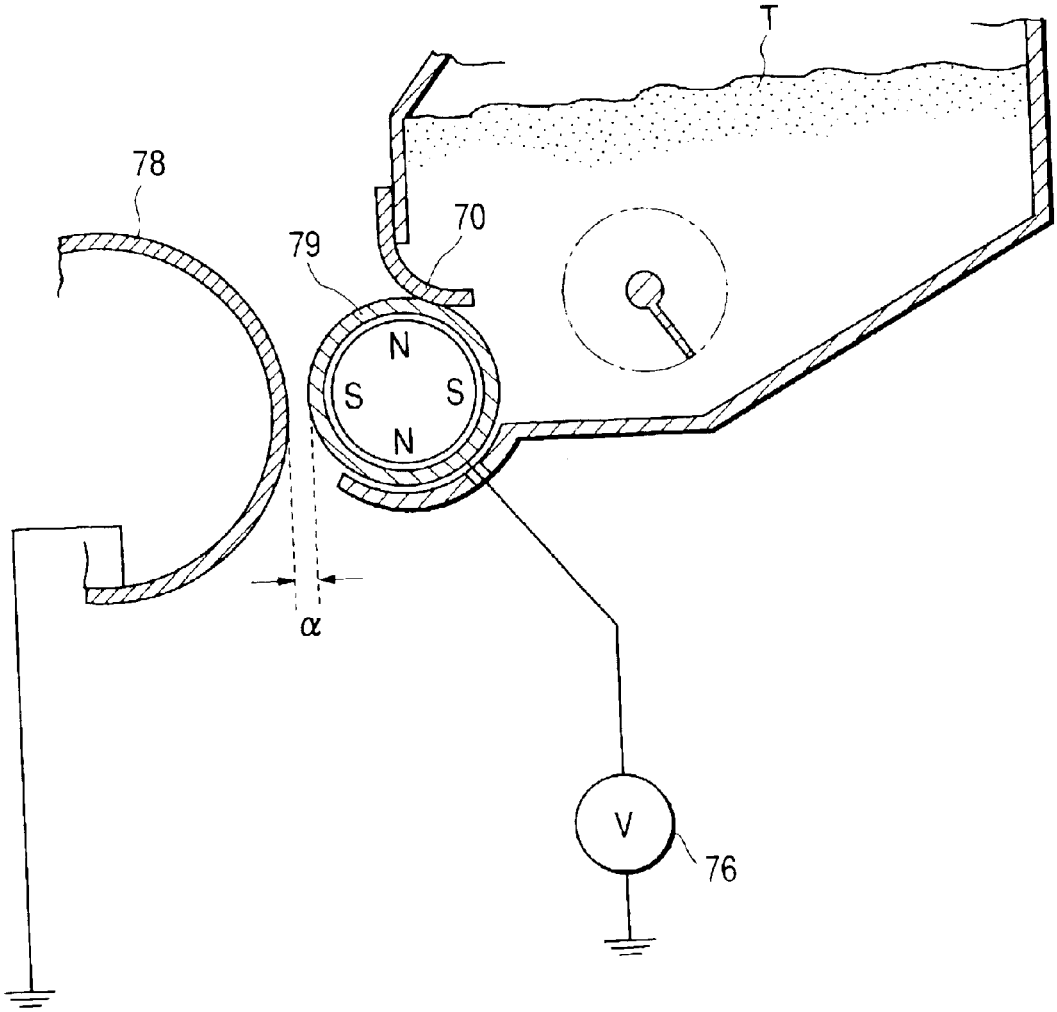
FIG. 5 is a schematic view showing another magnetic one-component developing unit.

An example in which the elastic blade is used is shown in FIG. 5.

An elastic blade 70 is, at its upper side base portion, fixedly held on the side of a developer container and is so provided that the inner face side (or the outer face side in the case of the adverse direction) of the elastic blade 70 is, at its lower side, brought into touch with the surface of a developing sleeve 79 under an appropriate elastic pressure in such a state that it is deflected against the elasticity of the elastic blade 70 in the forward direction or backward direction of the rotation of the developing sleeve 79. According to such construction, a toner layer can be formed which is thin and dense, being more stably even against environmental variations.

In the case when the elastic blade is used, the toner tends to melt-adhere to the sleeve and blade surfaces. However, the negatively chargeable toner of the present invention is preferably usable because it has superior releasability and stable triboelectric chargeability.

In the case of the magnetic one-component developing system, it is preferable for the elastic blade 70 to be brought into touch with the developing sleeve 79 at a pressure of 0.1 kg/m or more, preferably from 0.3 to 25 kg/m, and more preferably from 0.5 to 12 kg/m, as a linear pressure in the generatrix direction of the sleeve. The gap $\alpha$ between an image-bearing member 78 and the developing sleeve 79 may preferably be set to be, e.g., from 50 to 500 $\mu$m. The layer thickness of the magnetic-toner layer formed on the developing sleeve 79 may most preferably be made smaller than the gap $\alpha$ between the image-bearing member 78 and the developing sleeve 79. In some cases, the layer thickness of the magnetic-toner layer may be regulated in such an extent that part of a large number of ears of the magnetic toner constituting the magnetic-toner layer comes into contact with the surface of the image-bearing member 78.

The developing sleeve 79 is rotated at a peripheral speed of from 100 to 200% with respect to the image-bearing member 78. The alternating bias voltage applied by a voltage applying means 76 may preferably be applied at a peak-to-peak voltage of 0.1 kV or above, preferably from 0.2 to 3.0 kV, and more preferably from 0.3 to 2.0 kV. The alternating bias may be applied at a frequency of from 0.5 to 5.0 kHz, preferably from 1.0 to 3.0 kHz, and more preferably from 1.5 to 3.0 kHz. As the waveform of the alternating bias, rectangular waveform, sine waveform, saw-tooth waveform and triangle waveform may be used. An asymmetrical AC bias having different time for which forward/backward, voltages are applied may also be used. It is also preferable to superimpose a DC bias.

Figure 6:
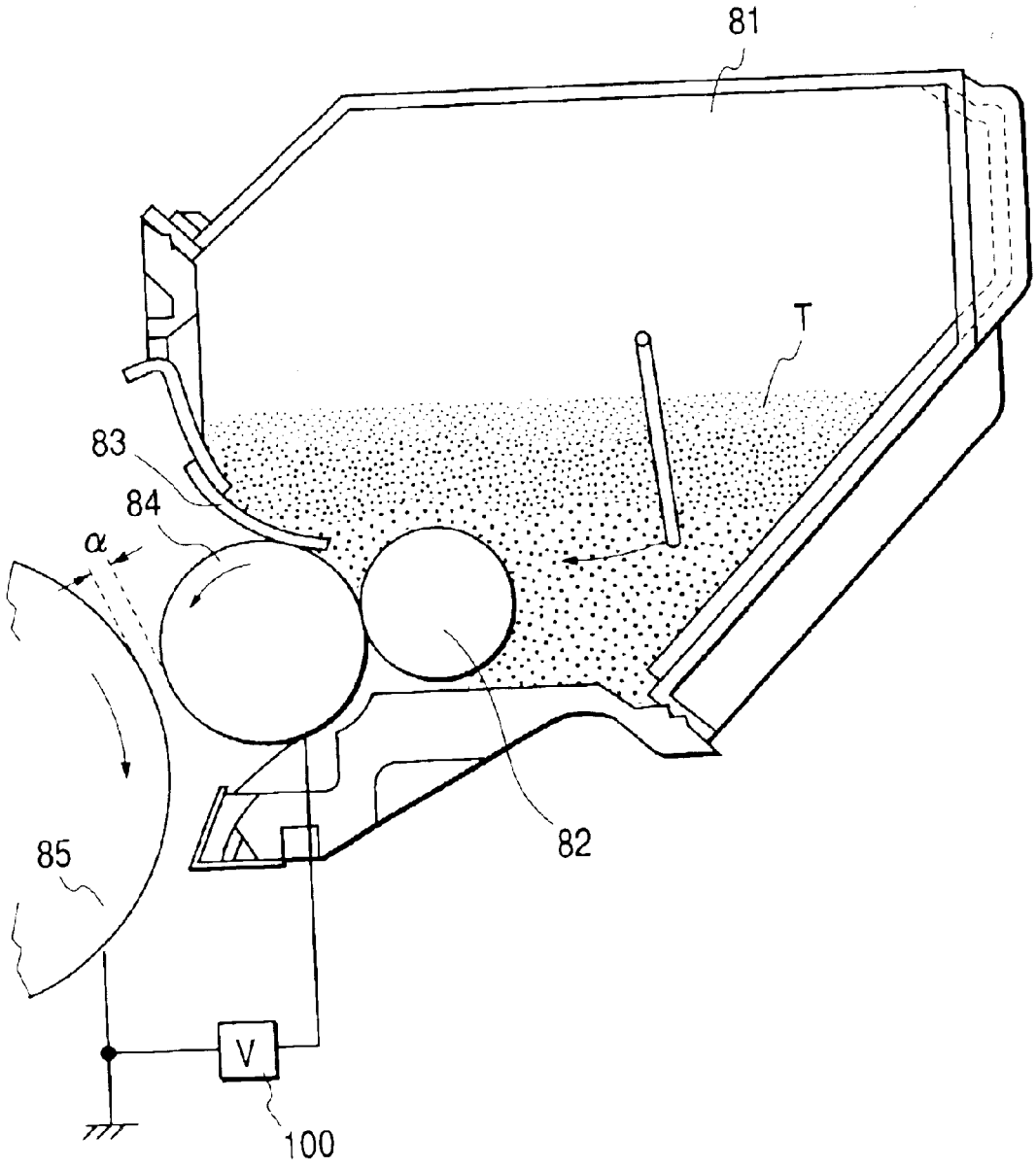
FIG. 6 is a schematic view showing a non-magnetic one-component developing unit.

An example of developing methods used when non-magnetic one-component development is performed is described below with reference to FIG. 6. Reference numeral 85 denotes an image-bearing member, on which latent images are formed by an electrophotographic processing means or electrostatic recording means (not shown). Reference numeral 84 denotes a developer-carrying member (developing sleeve), which is comprised of a non-magnetic sleeve made of aluminum or stainless steel. The developing sleeve 84 may be prepared using a crude pipe of aluminum or stainless as it is, and may preferably be prepared by spraying glass beads on it to uniformly rough the surface, by mirror-finishing its surface or by coating its surface with a resin.

Toner T is reserved in a hopper 81, and is fed onto the developing sleeve 84 by a toner coating roller 82. As the toner coating roller 82, a roller may preferably be used which is comprised of a porous elastic material (e.g., a foamed material such as a soft polyurethane foam). The roller is rotated at a relative speed that is not zero in the forward direction or backward direction with respect to the developing sleeve 84 so that the toner can be fed onto the developing sleeve 84 and also the toner remaining on the developing sleeve 84 after development (the toner not participated in development) can be stripped. Here, the width at which the toner coating roller 82 comes into contact with the developing sleeve 84 (i.e., nip width) may preferably be from 2.0 to 10.0 mm, and more preferably from 4.0 to 6.0 mm, taking account of the balance of the feeding and stripping of toner. While the toner inevitably undergoes stress to tend to cause an increase in agglomeration due to toner deterioration or cause melt-adhesion or sticking of toner to the developing sleeve 84 and toner coating roller 82, the negatively chargeable toner of the present invention has superior fluidity and releasability and also has running stability, and hence can preferably be used also in the developing assembly shown in FIG. 6. In place of the toner coating roller 82, a brush roller comprised of resin fiber such as nylon or Rayon fiber may also be used. The developing system shown in FIG. 6 is very effective in the one-component developing system making use of non-magnetic one-component toners.

The toner fed onto the developing sleeve 84 is coated in thin layer and uniformly by means of a regulating member 83. As to the toner regulating member 83, a method is particularly preferred in which the toner is coated on the developing sleeve 84 by an elastic blade or an elastic roller under pressure contact. As the elastic blade or elastic roller, it is preferable to use one made of a material of triboelectric series, suited for charging the toner electrostatically to the desired polarity. The toner regulating member 83 may preferably be formed of silicone rubber, urethane rubber or styrene-butadiene rubber. The toner regulating member 83 may also provided with an organic resin layer formed of polyamide, polyimide, nylon, melamine, melamine cross-linked nylon, phenol resin, fluorine resin, silicone resin, polyester resin, urethane resin, styrene resin or acrylic resin.

It is effective for the elastic blade or elastic roller to be brought into touch with the developing sleeve 84 at a pressure of from 0.1 to 25 kg/m, and preferably from 0.5 to 12 kg/m, as a linear pressure in the generatrix direction of the developing sleeve 84. The adjustment of touch pressure within the above range makes it possible to effectively loosen the agglomeration of toner and makes it possible to effect instantaneous rise of the charging of the toner.

In the system where the toner is thin-layer coated on the developing sleeve 84 by the blade, especially in the non-magnetic one-component developing system, the developing sleeve 84 is rotated at a peripheral speed of from 100% to 300% with respect to the image-bearing member 85 in order to attain a sufficient image density. It may preferably be rotated at a peripheral speed of from 120 to 250%.

It is preferable to make the thickness of the negatively chargeable toner layer on the developing sleeve 84 smaller than the gap length where the developing sleeve 84 faces the image-bearing member 85, and to form an alternating electric field at this gap. An alternating electric field or a development bias formed by superimposing a DC electric field to an alternating electric field may be applied to the developing sleeve 84 through a bias power source 100, whereby the toner can be made to move with ease from the developing sleeve 84 surface to the image-bearing member 85 surface, and images with a much better quality can be formed.

Figure 7:
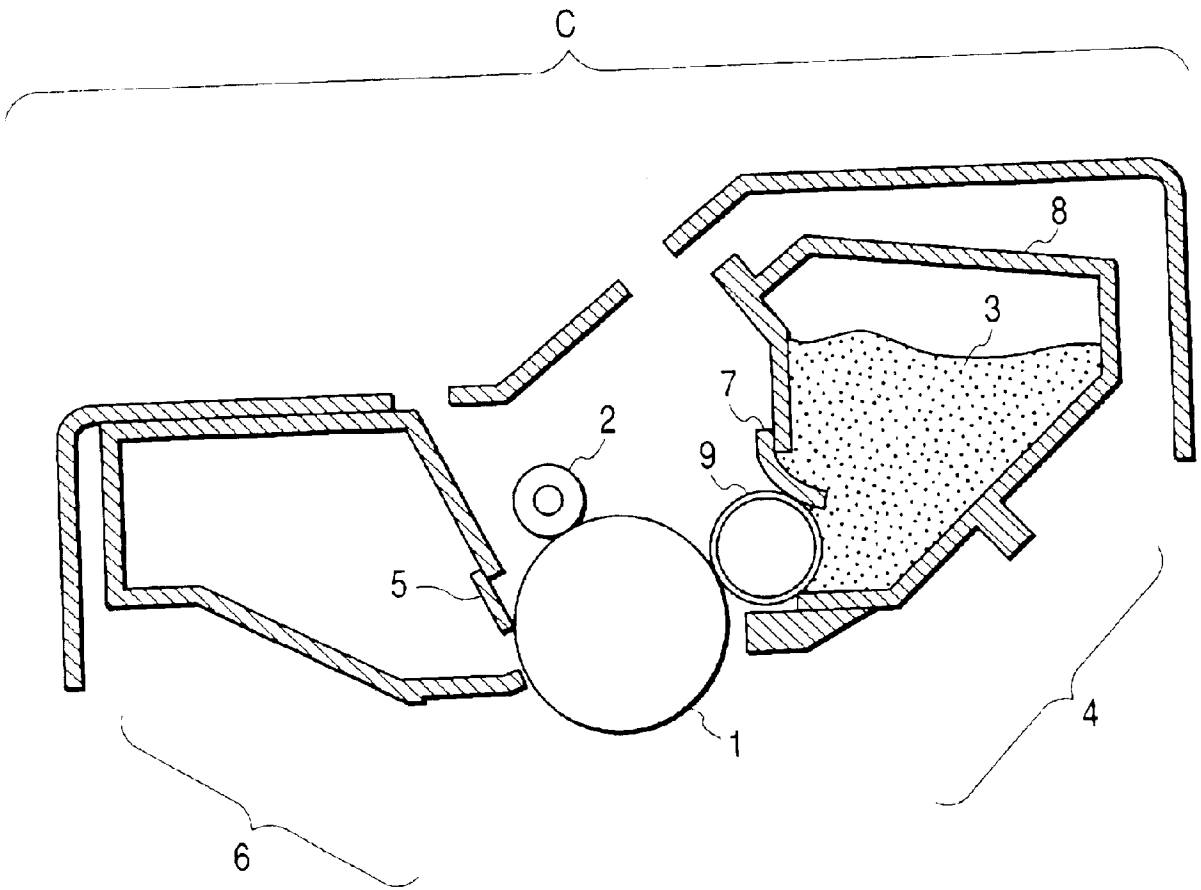
FIG. 7 is a schematic view showing the process cartridge of the present invention.

FIG. 7 illustrates an example of the process cartridge of the present invention.

In the process cartridge of the present invention, at least the developing means and the image-bearing member are joined into one unit as a cartridge, and the process cartridge is so constructed as to be detachably mountable to the main body of the image forming apparatus (e.g., a copying machine, a laser beam printer or a facsimile machine).

In the embodiment shown in FIG. 7, a process cartridge C is exemplified in which a developing means 4, an image-bearing member (photosensitive drum) 1, a cleaning means 6 having a cleaning blade 5 and a charging roller 2 as a charging means are joined into one unit.

In this embodiment, the developing means 4 has an elastic regulating blade 7 as a toner layer thickness regulating means and in a developer container 8 a developer 3 having the negatively chargeable toner of the present invention. At the time of development, a stated electric field is formed across the photosensitive drum 101 and the developing sleeve 9 as a toner-carrying member by applying a development bias voltage from a bias applying means, to perform the developing by the use of the developer 3.

As to the process cartridge shown in FIG. 7, an embodiment has been described in which the four constituents, the developing means 4, the image-bearing member 1, the cleaning means 6 and the charging means 2 are joined into one unit as a cartridge. In the present invention, at least two constituents, the developing means and the image-bearing member, may be joined into one unit as a cartridge. It is also possible to add constituents such as a charging means, a latent-image-forming means, a transfer means and a cleaning means so as to be joined together into one unit as a cartridge. For example, three constituents, the developing means, the image-bearing member and the cleaning means, or three constituents, the developing means, the image-bearing member and the primary charging means, may be combined into a cartridge.

Methods of measuring physical properties concerning the negatively chargeable toner of the present invention are enumerated below.

(1) Measurement of Acid Value of Toner:

Measured according to the measuring method prescribed in JIS K0070.

Measuring instrument: Automatic potentiometric titrator AT-400 (manufactured by Kyoto Denshi K.K.).

Calibration of instrument: A mixed solvent of 120 ml of toluene and 30 ml of ethanol is used.

Measurement temperature: 25° C.

Preparation of sample: 2.0 g of the magnetic toner (1.0 g in the case of the non-magnetic toner) is added to 120 ml of toluene, followed by stirring with a magnetic stirrer at room temperature (about 25° C.) for about 10 hours to effect dissolution. Further, 30 ml of ethanol is added to make a sample solution.

Measurement Procedure:

1) The magnetic toner is precisely weighed in an amount of 2.0 g (1.0 g in the case of the non-magnetic toner).
2) The toner is put in a 300 ml beaker, and 150 ml of a toluene/ethanol (4/1) mixed solvent is added thereto to dissolve it.
3) Using an ethanol solution of 0.1 mol/l of KOH, titration is made by means of a potentiometric titrator. (For example, automatic titration may be utilized which is made using a potentiometric titrator AT-400, WIN WORKSTATION, and an ABP-410 motor buret which are manufactured by Kyoto Denshi K.K.).
4) The amount of the KOH solution used here is represented by S (ml). A blank is measured at the same time, and the amount of the KOH solution used in the blank is represented by B (ml).
5) The acid value of the toner is calculated according to the following expression. Letter symbol f is the factor of KOH.

$$\text{Acid value (mg·KOH/g)}=\{(S-B)\times f\times 5.61\}/W.$$

(2) Measurement of Acid Value of the Vinyl Copolymer and Binder Resin According to the Present Invention:

The measuring instrument, calibration of instrument, measurement temperature and preparation of sample are the same as those for the measurement on the toner.

Measurement Procedure:

1) The vinyl copolymer or binder resin according to the present invention is precisely weighed in an amount of 0.5 g.
2) The above is put in a 300 ml beaker, and 150 ml of a toluene/ethanol (4/1) mixed solvent is added thereto to dissolve it.

3) Using an ethanol solution of 0.1 mol/l of KOH, titration is made by means of a potentiometric titrator. (For example, automatic titration may be utilized which is made using a potentiometric titrator AT-400, WIN WORKSTATION, and an ABP-410 motor buret which are manufactured by Kyoto Denshi K.K.).
4) The amount of the KOH solution used here is represented by S (ml). A blank is measured at the same time, and the amount of the KOH solution used in the blank is represented by B (ml).
5) The acid value of the toner is calculated according to the following expression. Letter symbol f is the factor of KOH.

$$\text{Acid value (mg·KOH/g)}=\{(S-B)\times f\times 5.61\}/W.$$

(3) Measurement of Molecular Weight of THF-Soluble Matter:

The THF-soluble matter of the vinyl copolymer, binder resin or negatively chargeable toner of the present invention is measured by GPC using THF (tetrahydrofuran) as a solvent, under the following conditions. Molecular weight of 1,000 or more is measured.

Columns are stabilized in a 40° C. heat chamber. To the columns kept at this temperature, THF as a solvent is made to flow at a flow rate of 1 ml per minute, and about 100 μl of a sample THF solution is injected thereinto to make measurement. In measuring the molecular weight of the sample, the molecular weight distribution the sample has is calculated from the relationship between the logarithmic value of a calibration curve prepared using several kinds of monodisperse polystyrene standard samples and the value of count. As the standard polystyrene samples used for the preparation of the calibration curve, it is suitable to use samples with molecular weights of from 100 to 10,000,000, which are available from, e.g., Tosoh Corporation or Showa Denko K.K., and to use at least about 10 standard polystyrene samples. An RI (refractive index) detector is also used as a detector. Columns should be used in combination of a plurality of commercially available polystyrene gel columns. For example, they may preferably comprise a combination of SHODEX GPC KF-801, KF-802, KF-803, KF-804, KF-805, KF-806, KF-807 and KF-800P, available from Showa Denko K.K.; or a combination of TSKgel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guard column, available from Tosoh Corporation.

The sample is prepared in the following way.

The sample is put in THF, and is left for several hours, followed by thorough shaking so as to be well mixed with the THF (until coalescent matter of the sample has disappeared), which is further left at rest for at least 12 hours. Here, the sample is so left as to stand in THF for at least 24 hours. Thereafter, the solution having been passed through a sample-treating filter (pore size: 0.2 to 0.5 μm; for example, MAISHORIDISK H-25-2, available from Tosoh Corporation may be used) is used as the sample for GPC. The sample is also so adjusted as to have resin components in a concentration of from 0.5 to 5 mg/ml.

(4) Measurement of THF-Insoluble Matter:

A toner sample on which the THF-insoluble matter is to be measured is precisely weighed in an amount of from 0.5 to 1.0 g, which is then put in a cylindrical filter paper (for example, No. 86R, available from Toyo Roshi K.K.; size: 28 mm in outer diameter×100 mm in height) and set on a Soxhlet extractor. The extraction solvent THF is used in an amount of 200 ml. Extraction is carried out using an oil bath, controlling its temperature to 120° C. to 130° C. The time taken for every reflux is so adjusted as to come to 120 to 150 seconds. The extraction is carried out for 10 hours. After the extraction has been completed, the cylindrical filter paper is dried at 70° C. for 10 hours under reduced pressure. Then, the THF-insoluble matter is calculated from the following expression.

$$\text{THF-insoluble matter (\% by weight)}=[\{W_1-(W_3+W_2)\}/(W_1-W_3)]\times 100(\%)$$

wherein $W_1$ represents the weight of the toner sample; $W_2$, THF-soluble component; and $W_3$, components other than the binder resin which are contained in the toner (e.g., the magnetic material, the wax, the external additives and so forth).

(5) Measurement of Endothermic Peak Temperature of Wax:

Measured according to ASTM D3418-82, using a differential scanning calorimeter (DSC measuring instrument) DSC-7, manufactured by Perkin-Elmer Corporation.

A sample for measurement is precisely weighed in an amount of 2 to 10 mg, preferably 5 mg.

This sample is put in a pan made of aluminum and an empty aluminum pan is used as reference. Measurement is made in a normal-temperature normal-humidity environment at a heating rate of 10° C./min within the measurement temperature range of from 30° C. to 200° C. In the course of this heating, a main-peak endothermic peak of the DSC curve is obtained in the temperature range of from 30° C. to 200° C. The temperature of this endothermic main peak is regarded as the melting point of the wax.

(6) Measurement of Glass Transition Temperature (Tg) of the Vinyl Copolymer, Binder Resin or Negatively Chargeable Toner of the Present Invention:

Measured according to ASTM D3418-82, using a differential scanning calorimeter (DSC measuring instrument) DSC-7, manufactured by Perkin-Elmer Corporation.

A sample for measurement is precisely weighed in an amount of 5 to 20 mg, preferably 10 mg.

This sample is put in a pan made of aluminum and an empty aluminum pan is used as reference. Measurement is made in a normal-temperature normal-humidity environment at a heating rate of 10° C./min within the measurement temperature range of from 30° C. to 200° C. In the course of this heating, a main-peak endothermic peak of the DSC curve is obtained in the temperature range of from 40° C. to 100° C.

The point at which the line showing a middle point of the base line before and after the appearance of the endothermic peak thus obtained and the differential thermal curve intersect is regarded as the glass transition temperature Tg.

(7) Measurement of DSC Curve of Toner:

The DSC curve in the course of heating of the toner is measured in the same manner as the above measurement of the melting point of the wax.

(8) Measurement of Molecular Weight Distribution of Wax:

GPC measuring instrument: GPC-150C (manufactured by Waters Co.).
Columns: GMH-HT 30 cm, combination of two columns (available from Tosoh Corporation).
Temperature: 135° C.
Solvent: o-Dichlorobenzene (0.1% ionol-added).
Flow rate: 1.0 ml/min.
Sample: 0.4 ml of sample with concentration of 0.15% is injected.

Molecular weight is measured under conditions shown above. Molecular weight of the sample is calculated using a molecular-weight calibration curve prepared from a monodisperse polystyrene standard sample. The calculated value is further calculated by converting the value in terms of polyethylene according to a conversion equation derived from the Mark-Houwink viscosity equation.

(9) Measurement of Particle Size Distribution of Toner:

The particle size distribution of the negatively chargeable toner of the present invention is measured with Coulter Counter Model TA-II or Coulter Multisizer (manufactured by Coulter Electronics, Inc.). As an electrolytic solution, an aqueous 1% NaCl solution is prepared using first-grade sodium chloride. For example, ISOTON R-II (manufactured by Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution of the toner are calculated by measuring the volume and number of toner particles of 2 $\mu$m or more in diameter by means of the above measuring instrument, using an aperture of 100 $\mu$m as its aperture.

As channels, 13 channels are used, which are channels of 2.00 to less than 2.52 $\mu$m, 2.52 to less than 3.17 $\mu$m, 3.17 to less than 4.00 $\mu$m, 4.00 to less than 5.04 $\mu$m, 5.04 to less than 6.35 $\mu$m, 6.35 to less than 8.00 $\mu$m, 8.00 to less than 10.08 $\mu$m, 10.08 to less than 12.72 $\mu$m, 12.72 to less than 16.00 $\mu$m, 16.00 to less than 20.02 $\mu$m, 20.02 to less than 25.40 $\mu$m, 25.40 to less than 32.00 $\mu$m, and 32.00 to less than 40.30 $\mu$m.

(10) Measurement of Content of Heterogeneous Element (s) in Magnetic Iron Oxide:

The content of the heterogeneous element in the magnetic iron oxide may be measured by fluorescent X-ray analysis according to JIS K0119 "General Rules for Fluorescent X-ray Analysis", using a fluorescent X-ray analyzer SYSTEM 3080 (manufactured by Rigaku Denki Kogyo K.K.).

(11) Measurement of Incorporation Distribution of Heterogeneous Element in Magnetic Iron Oxide:

As to the incorporation distribution of the heterogeneous element in the magnetic iron oxide, it is ascertained by measuring and quantitatively determining the quantities of elements in the state of being dissolved in hydrochloric acid or hydrofluoric acid, by inductively coupled plasma (ICP) spectrometry to find their dissolution percentage from the concentration of each element at the time of each dissolution with respect to the concentrations of all elements at the time of whole dissolution.

(12) Measurement of Number-Average Particle Diameter of Magnetic Material:

To determine the number-average particle diameter of the magnetic material, a photograph taken at a magnifying power of 40,000 times on a transmission electron microscope may be used, where 300 particles of the magnetic material are picked up at random and the measurement is made with a digitizer.

(13) Measurement of Magnetic Properties of Magnetic Material:

The magnetic properties of the magnetic material are measured with a vibration sample magnetic-force meter VSM-3S-15 (manufactured by Toei Kogyo K.K.) under application of an external magnetic field of 795.8 kA/m.

(14) Measurement of Specific Surface Area of Magnetic Material and External-Additive Fine Powder:

To measure the specific surface area of the magnetic material and external-additive fine powder, nitrogen gas is adsorbed on sample surfaces using a specific surface area measuring device AUTOSOBE 1 (manufactured by Yuasa Ionics Co.), and the specific surface area is calculated by the BET multiple-point method.

(15) Measurement of Dielectric Dissipation Factor of Toner:

Using 4284A PRECISION LCR METER (manufactured by Hewlett-Packard Co.), calibration is made at frequencies of 1 kHz and 1 MHz, and dielectric dissipation factor (tan $\delta=\epsilon''/\epsilon'$) is calculated from measurements of dielectric constant.

The magnetic toner is weighed in an amount of 0.7 g (0.4 g in the case of the non-magnetic toner), which is then molded under application of a load of 39,200 kPa (400 kgf/cm$^2$) for 2 minutes to prepare a disk-shaped measuring sample of 25 mm in diameter and 1 mm or less (preferably 0.5 mm to 0.9 mm) in thickness. This measuring sample is attached to ARES (manufactured by Rheometric Scientific F.E. Co.) fitted with a dielectric constant measuring jig (electrode) of 25 mm in diameter, followed by heating to a temperature of 130° C. to melt-fix the sample. Thereafter, this is cooled to a temperature of 25° C., and a load of 0.49 N (50 g) is applied, in the state of which, keeping the frequency constant at 100 kHz, the sample is heated at a heating rate of 2° C./minute, up to 150° C. taking the measurements in at intervals of 15 minutes to determine the dielectric dissipation factor.

(16) Measurement of Methanol Wettability of Inorganic Fine Powder:

The methanol wettability of the inorganic fine powder to be added to the negatively chargeable toner of the present invention may be measured with a powder wettability tester (WET-100P, manufactured by Resuka K.K.).

Stated specifically, 50 ml of pure water (ion-exchanged water or commercially available purified water) is put into a 100 ml beaker, and precisely weighed 0.2 g of the inorganic fine powder is added thereto, where methanol is dropwise added at a rate of 3 ml/minute with stirring. As the inorganic fine powder begins to settle and disperse in the aqueous phase, the transparency of the aqueous liquid decreases, and hence the methanol concentration at this point may be regarded as the methanol wettability. That is, it may be found according to the following equation.

$$\text{Methanol wettability } (\%)=W/(W+50)\times 100$$

(W: the amount of methanol added dropwise.)

EXAMPLES

The present invention is described below by giving working examples. The present invention is by no means limited to these working examples.

Production of Vinyl Copolymers of the Present Invention:

Production Example 1

Into a four-necked separable flask having a stirrer, a condenser, a thermometer and a nitrogen feed pipe, 80 parts by weight of styrene, 4 parts by weight of N-butoxymethylacryamide (A1), 16 parts by weight of monobutyl maleate (B1), 100 parts by weight of 2-butanone, 200 parts by weight of 2-propanol, 200 parts by weight of methanol and 2 parts by weight of 2,2'-azobis(2-methylbutyronitrile) were introduced, followed by stirring to carry out solution polymerization at 65° C. for 8 hours under the feeding of nitrogen. Thereafter, the polymerization solvents were evaporated off under reduced pressure, and then the resultant polymer was roughly pulverized to come to 100 μm or less in particle diameter to obtain a vinyl copolymer (C-1) of the present invention.

The vinyl copolymer (C-1) thus obtained had a glass transition temperature (Tg) of 80.3° C., a weight-average molecular weight (Mw) of 35,000 and an acid value of 18.8 mg·KOH/g.

Production Example 2

A vinyl copolymer (C-2) of the present invention, having glass transition temperature, weight-average molecular weight and acid value as shown in Table 1 was obtained in the same manner as in Production Example 1 except that the styrene was used in an amount of 88 parts by weight and the N-butoxymethylacryamide (A1) and the monobutyl maleate (B1) were changed for 4 parts by weight of N-methylmethacryamide (A2) and 8 parts by weight of succinic-acid monohydroxyethyl methacrylate (B2), respectively.

Production Example 3

A vinyl copolymer (C-3) of the present invention, having glass transition temperature, weight-average molecular weight and acid value as shown in Table 1 was obtained in the same manner as in Production Example 2 except that the N-methylmethacryamide (A2) and the succinic-acid monohydroxyethyl methacrylate (B2) were changed for N-isopropylacrylamide (A3) and acrylic-acid dimer (B3), respectively.

Production Example 4

A vinyl copolymer (C-4) of the present invention, having glass transition temperature, weight-average molecular weight and acid value as shown in Table 1 was obtained in the same manner as in Production Example 3 except that the N-isopropylacrylamide (A3) was changed for N,N-dimethylacrylamide (A4).

Production Example 5

A vinyl copolymer (C-5) of the present invention, having glass transition temperature, weight-average molecular weight and acid value as shown in Table 1 was obtained in the same manner as in Production Example 3 except that the N-isopropylacrylamide (A3) was changed for acryloylmorpholine (A5).

Comparative Production Example 1

A vinyl copolymer (RC-1), having glass transition temperature, weight-average molecular weight and acid value as shown in Table 1 was obtained in the same manner as in Production Example 1 except that the styrene was used in an amount of 96 parts by weight; the N-butoxymethylacryamide (A1), 4 parts by weight, and the 2,2'-azobis(2-methylbutyronitrile), 4 parts by weight.

Comparative Production Example 2

A vinyl copolymer (RC-2), having glass transition temperature, weight-average molecular weight and acid value as shown in Table 1 was obtained in the same manner as in Production Example 1 except that the styrene was used in an amount of 92 parts by weight and the monobutyl maleate (B1) was changed for 8 parts by weight of succinic-acid monohydroxyethyl methacrylate (B2).

TABLE 1

| | | Formulation of monomer composition | | | | | | | | |
|---|---|---|---|---|---|---|---|---|---|---|
| | Vinyl | Monomer (A) | | Monomer (B) | | Other vinyl monomer | | Acid | | |
| | co-polymer | Type | Amt. (pbw) | Type | Amt. (pbw) | Type | Amt. (pbw) | value (mg · KOH/g) | Mw | Tg (° C.) |
| Production Example: | | | | | | | | | | |
| 1 | C-1 | N-butoxy-methyl-acrylamide | 4 | Monobutyl maleate | 16 | Styrene | 80 | 18.8 | 35,000 | 80.3 |
| 2 | C-2 | N-methyl-methacryl-amide | 4 | Succinic-acid mono-hydroxyethyl methacrylate | 8 | Styrene | 88 | 20.1 | 37,000 | 82.5 |
| 3 | C-3 | N-isopropyl-acrylamide | 4 | Acrylic-acid dimer | 8 | Styrene | 88 | 21.1 | 40,800 | 87.2 |
| 4 | C-4 | N,N-dimethyl-acrylamide | 4 | Acrylic-acid dimer | 8 | Styrene | 88 | 22.3 | 41,500 | 90.8 |
| 5 | C-5 | Acryloyl-morpholine | 4 | Acrylic-acid dimer | 8 | Styrene | 88 | 22.6 | 42,000 | 92.4 |
| Comparative Production Example: | | | | | | | | | | |
| 1 | RC-1 | N-butoxy-methyl-acrylamide | 4 | — | — | Styrene | 96 | 0 | 13,000 | 66.1 |

TABLE 1-continued

| | Vinyl co-polymer | Formulation of monomer composition: Monomer (A) Type | Monomer (A) Amt. (pbw) | Monomer (B) Type | Monomer (B) Amt. (pbw) | Other vinyl monomer Type | Other vinyl monomer Amt. (pbw) | Acid value (mg · KOH/g) | Mw | Tg (° C.) |
|---|---|---|---|---|---|---|---|---|---|---|
| 2 | RC-2 | — | — | Succinic-acid mono-hydroxyethyl methacrylate | 8 | Styrene | 92 | 33.6 | 35,000 | 80.5 |

Amt.: Amount
pbw: parts by weight

Production of Binder Resins:

Binder Resin

Production Example 1

200 parts by weight of xylene was introduced into a reaction container having a reflux tube, a stirrer, a thermometer, a nitrogen feed pipe, a dropping funnel and a vacuum unit, and thereafter 79 parts by weight of styrene, 17 parts by weight of butyl acrylate, 4 parts by weight of monobutyl maleate and as a polymerization initiator 4 parts by weight of di-t-butyl peroxide were introduced, followed by heating to reflux temperature with aeration of nitrogen, which was retained for 12 hours. Thereafter, the xylene was evaporated off under reduced pressure to obtain a low-molecular-weight polymer (L-1) having an Mw of 7,000, a Tg of 57.4° C. and an acid value of 12 mg·KOH/g.

Binder Resin

Production Example 2

Into a reaction container having a reflux tube, a stirrer, a thermometer and a nitrogen feed pipe, into which 2 parts by weight of polyvinyl alcohol and 200 parts by weight of deaerated ion-exchanged water were introduced, a monomer mixture composed of 72 parts by weight of styrene, 26 parts by weight of butyl acrylate, 2 parts by weight of monobutyl maleate and 0.3 part by weight of a polymerization initiator 2,2'-bis(4,4-di-t-butylperoxycyclohexyl)propane were introduced and suspended. This system was heated to 75° C. with aeration of nitrogen, which was retained at this temperature for 20 hours and then, after addition of 0.5 part by weight of benzoyl peroxide, further retained for 4 hours, followed by heating to 95° C., which was retained at this temperature for 2 hours to complete polymerization. Thereafter, the suspension formed was filtered and washed with water, followed by drying to obtain a high-molecular-weight polymer (H-1) having an Mw of 1,230,000, a Tg of 59.5° C. and an acid value of 3 mg·KOH/g.

Binder Resin

Production Example 3

In a mixing container having a reflux tube, a stirrer, a thermometer and a vacuum unit, 75 parts by weight of the low-molecular-weight polymer (L-1) and 25 parts by weight of the high-molecular-weight polymer (H-1) were added to 200 parts by weight of xylene. These were heated and dissolved, and then the xylene was evaporated off under reduced pressure to obtain a binder resin (B-1) having a main peak at a molecular weight of 7,900 and a sub-peak at molecular weight of 890,000 and having an Mw of 230,000 and an acid value of 10 mg·KOH/g.

Binder Resin

Production Example 4

| | |
|---|---|
| Terephthalic acid | 34 mol % |
| Trimellitic anhydride | 12 mol % |
| Bisphenol-A derivative represented by the formula (A) | 16 mol % |

Formula (A)

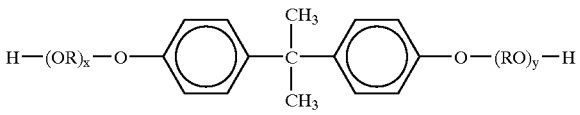

(R: ethylene group; x + y = 2.4)

| | |
|---|---|
| Bisphenol-A derivative represented by the formula (A) | 28 mol % |

Formula (A)

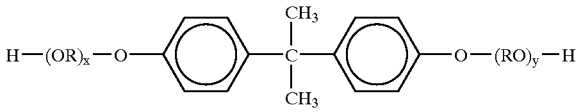

(R: propylene group; x + y = 2.2)

The above carboxylic acids and alcohols were introduced into a reaction container having a condenser, a stirrer, a thermometer, a nitrogen feed pipe and a vacuum unit, followed by addition of dibutyltin oxide as an esterification catalyst and then heating to 160° C. in an atmosphere of nitrogen. Subsequently, the inside of the reaction container was evacuated to about 50 hPa, followed by heating to 220° C. These temperature and pressure were retained for 6 hours to complete esterification reaction to form a polyester resin (P-1) having an Mw of 15,700, a Tg of 57.5° C. and an acid value of 27 mg·KOH/g.

Binder Resin

Production Example 5

| | |
|---|---|
| Fumaric acid | 4 mol % |
| Terephthalic acid | 16 mol % |
| Benzoic acid | 60 mol % |
| Bisphenol-A derivative represented by the formula (A) | 10 mol % |

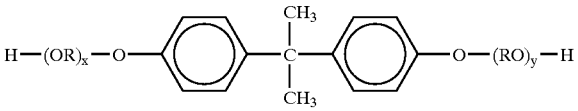

Formula (A)

(R: ethylene group; x + y = 2.4)

| | |
|---|---|
| Bisphenol-A derivative represented by the formula (A) | 10 mol % |

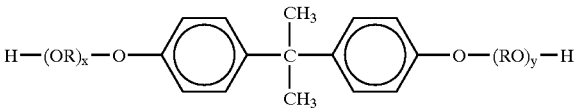

Formula (A)

(R: propylene group; x + y = 2.2)

The above carboxylic acids and alcohols were introduced into a reaction container having a condenser, a stirrer, a thermometer, a nitrogen feed pipe and a vacuum unit, followed by addition of dibutyltin oxide as an esterification catalyst and then heating to 160° C. in an atmosphere of nitrogen. Subsequently, the inside of the reaction container was evacuated to about 50 hPa, followed by heating to 190° C. These temperature and pressure were retained for 6 hours to complete esterification reaction to form an unsaturated polyester resin (P-2) having an Mw of 7,200, a Tg of 48.2° C. and an acid value of 24 mg·KOH/g.

Binder Resin

Production Example 6

300 parts by weight of xylene was introduced into a reaction container having a reflux tube, a stirrer, a thermometer, a nitrogen feed pipe, a dropping funnel and a vacuum unit. Thereafter, 80 parts by weight of the polyester resin (P-1) and 20 parts by weight of the unsaturated polyester resin (P-2), capable of reacting with a vinyl monomer to form a hybrid resin component, were added and dissolved, and then 72 parts by weight of styrene, 23 parts by weight of butyl acrylate, 5 parts by weight of monobutyl maleate and as a polymerization initiator 2 parts by weight of di-t-butyl peroxide were introduced, followed by heating to reflux temperature with aeration of nitrogen, which was retained for 12 hours. Thereafter, the xylene was evaporated off under reduced pressure to obtain a hybrid resin (HB-1) having an Mw of 41,000, a Tg of 58.6° C. and an acid value of 25 mg·KOH/g.

Production of Negatively Chargeable Toner: Example 1

| | |
|---|---|
| Binder resin (B-1) | 100 parts |
| Wax (a hydrocarbon wax; endothermic peak temperature: 102° C.; peak molecular weight: 1,020; Mw/Mn: 1.6) | 4 parts |
| Vinyl copolymer (C-1) | 2 parts |
| Magnetic iron oxide (average particle diameter: 0.16 μm; coercive force: 10.2 kA/m; residual magnetization: 10.8 $Am^2/kg$; saturation magnetization: 83.3 $Am^2/kg$) | 100 parts |

A mixture of the above materials was melt-kneaded by means of a twin-screw extruder heated to 130° C. The kneaded product obtained was cooled and then crushed by means of a cutter mill to form a powdery material comprised of 95% by weight of 18 mesh-pass particles and 93% by weight of 100 mesh-on particles. The powdery material was then finely pulverized using TURBO MILL T-250, manufactured by Turbo Kogyo K.K. The finely pulverized product was classified by means of a multi-division air classifier utilizing the Coanda effect to carry out classification into three particle size powders, a coarse powder, a medium powder and a fine powder, to obtain magnetic toner particles (1) with a weight-average particle diameter of 7.0 μm.

1.2 parts by weight of hydrophobic dry-process silica treated with dimethylsilicone oil (viscosity: 100 $mm^2/s$) and thereafter treated with hexamethyldisilazane each in an amount of 10% by weight based on the weight of the silica base (methanol wettability of the treated silica: 67%; BET specific surface area: 200 $m^2/g$) was externally added to 100 parts by weight of the magnetic toner particles (1) by means of a Henschel mixer to obtain a magnetic toner (1).

The magnetic toner (1) had an acid value of 11 mg·KOH/g, and the binder resin of the toner contained 2.5% by weight of THF-insoluble matter. Its THF-soluble matter had a main peak at a molecular weight of 7,600 and a sub-peak at molecular weight of 588,000.

As to the dielectric dissipation factor, the toner had a maximum value at 125° C., which value was $5.2\times10^{-2}$. These physical properties are shown in FIG. 2.

Then, using this magnetic toner, the following evaluation was made. As a result, good results were obtained as shown in Table 3.

Evaluation on Fog and Image Quality:

As the evaluation of developing performance of the toner, evaluation was made on image fog and image quality by conducting a 100,000-sheet running image evaluation test in a high-temperature and high-humidity environment (30° C./80% RH), using a digital copying machine iR-6000, manufactured by CANON INC., having the developing unit construction as shown in FIG. 1.

The reflectance (%) of white areas (non-image areas) of images for which the evaluation is made on fog and the reflectance (%) of virgin paper are measured with a fog-measuring reflection measuring instrument REFLECTMETER (manufactured by Tokyo Denshoku K.K.). The difference between the both (virgin-paper reflectance−image white-area reflectance) is regarded as fog (%).

Rank 5: Fog is less than 0.1%.
Rank 4: Fog is 0.1% or more to less than 0.5%.
Rank 3: Fog is 0.5% or more to less than 1.5%.
Rank 2: Fog is 1.5% or more to less than 2.0%.
Rank 1: Fog is 2.0% or more.

Images were also evaluated according to the following criteria.

Rank 5: Images are faithful to an original.
Rank 4: Images enlarged with a loupe are seen to have a little black spots around line images.
Rank 3: Images enlarged with a loupe are seen to have black spots around line images and stand disordered.
Rank 2: In visual observation, images are seen to have black spots around line images and stand disordered.
Rank 1: Original images are not reproduced.

Image Density Stability:

To evaluate image density stability, a 100,000-sheet running test is conducted in a normal-temperature and normal-humidity environment (23° C./60% RH), using the digital copying machine iR-6000, manufactured by CANON INC., and the density (F) of the last image is measured. Next, the developing assembly is detached from the copying machine and left in the high-temperature and high-humidity environment (30° C./80% RH) for 48 hours. Incidentally, when the developing assembly is left in the high-temperature and high-humidity environment, the developing assembly is packed in order to prevent sweating, and is unpacked after temperature control and moisture conditioning for 5 hours or more. After the leaving, the developing assembly is taken out in the normal-temperature and normal-humidity environment, and this developing assembly is set in iR-6000. After its developing sleeve is rotated for 1 minute, evaluation images are sampled on 10 sheets. An average value of their image densities is regarded as after-leaving density (R). The image density stability was evaluated by a difference between before-leaving density (F) and the after-leaving density (R), (F)−(R).

Rank 5: The value of (F)−(R) is 0 to less than 0.05.
Rank 4: The value of (F)−(R) is 0.05 or more to less than 0.10.
Rank 3: The value of (F)−(R) is 0.10 or more to less than 0.15.
Rank 2: The value of (F)−(R) is 0.15 or more to less than 0.20.
Rank 1: The value of (F)−(R) is 0.20 or more.

Examples 2 to 5

Magnetic toners (2) to (5) of the present invention were produced in the same manner as in Example 1 except that the vinyl copolymers (C-2) to (C-5), respectively, were used in place of the vinyl copolymer (C-1) serving as a charge control agent. These toners were measured and evaluated in the same manner as in Example 1 to obtain the results shown in Tables 2 and 3.

Example 6

A magnetic toner (6) of the present invention was produced in the same manner as in Example 5 except that 1 part by weight of a charge control agent (an organoaluminum compound comprised of 2 mols of 3,5-di-tert-butylsalicylic acid and 1 mol of aluminum) was further added. As a result, the toner contained 10% by weight of THF-insoluble matter. This toner was measured and evaluated in the same manner as in Example 1 to obtain the results shown in Tables 2 and 3.

Example 7

A magnetic toner (7) of the present invention was produced in the same manner as in Example 5 except that 1 part by weight of a charge control agent (an organoiron compound comprised of 2 mols of the azo compound represented by the formula (6) and 1 mol of iron atoms) was further added. This toner was measured and evaluated in the same manner as in Example 1 to obtain the results shown in Tables 2 and 3.

Example 8

A magnetic toner (8) of the present invention was produced in the same manner as in Example 5 except that the binder resin was changed for the polyester resin (P-1). As a result, the magnetic toner (8) had an acid value of 16 mg·KOH/g. Its THF-soluble matter had a main peak at a molecular weight of 8,300 and contained 7% by weight of the component held in the region of molecular weight of from 100,000 or more to less than 10,000,000 and 19% by weight of the component held in the region of molecular weight of from 1,000 or more to less than 5,000. The dielectric dissipation factor of the toner was $6.1\times10^{-2}$. This toner was measured and evaluated in the same manner as in Example 1 to obtain the results shown in Tables 2 and 3.

Example 9

A magnetic toner (9) of the present invention was produced in the same manner as in Example 5 except that the binder resin was changed for the hybrid resin (HB-1). As a result, the magnetic toner (9) had an acid value of 13 mg·KOH/g. Its THF-soluble matter had a main peak at a molecular weight of 7,900 and contained 7% by weight of the component held in the region of molecular weight of from 100,000 or more to less than 10,000,000 and 18% by weight of the component held in the region of molecular weight of from 1,000 or more to less than 5,000. The dielectric dissipation factor of the toner was $4.7\times10^{-2}$. This toner was measured and evaluated in the same manner as in Example 1 to obtain the results shown in Tables 2 and 3.

Example 10

A magnetic toner (10) of the present invention was produced in the same manner as in Example 5 except that the external additive was changed for 1.2 parts by weight of hydrophobic dry-process silica treated with 20% by weight of hexamethyldisilazane (methanol wettability: 65%; BET specific surface area: 200 $m^2/g$). This toner was measured and evaluated in the same manner as in Example 1 to obtain the results shown in Tables 2 and 3.

Example 11

Non-magnetic toner particles (1) were produced in the same manner as in Example 1 except that 8 parts by weight of carbon black was added in place of the magnetic iron oxide. The hydrophobic dry-process silica was externally added in the same manner as in Example 1, and thereafter 93 parts by weight of a carrier was added to 7 parts by weight of the non-magnetic toner particles (1) to obtain a two-component, non-magnetic toner (1).

This toner was used in a modified machine of a commercially available full-color copying machine like that shown in FIG. 2, to make evaluation in the same manner as in Example 1. As its developing assembly, the one constructed as shown in FIG. 4 was used. The results of measurement and evaluation are shown in Tables 2 and 3.

Example 12

A one-component, non-magnetic toner (2) was obtained in the same manner as in Example 1 except that 8 parts by weight of C.I. Pigment Blue 15:3 was added in place of the magnetic iron oxide. This toner was used in a modified machine of a commercially available full-color copying machine like that shown in FIG. 3, to make evaluation in the same manner as in Example 1. As its developing assembly, the one constructed as shown in FIG. 5 was used. The results of measurement and evaluation are shown in Tables 2 and 3.

Comparative Example 1

A comparative magnetic toner (1) was produced in the same manner as in Example 1 except that the comparative vinyl copolymer (RC-1) was used in place of the vinyl copolymer (C-1). Measurement and evaluation were made in the same manner as in Example 1 to obtain the results shown in Tables 2 and 3.

Comparative Example 2

A comparative magnetic toner (2) was produced in the same manner as in Example 1 except that the vinyl copolymer was not incorporated and also, as a charge control agent, an organozinc compound comprised of 3,5-di-t-butylsalicylic acid and zinc atoms was used. Measurement and evaluation were made in the same manner as in Example 1 to obtain the results shown in Tables 2 and 3.

Comparative Example 3

A comparative magnetic toner (3) was produced in the same manner as in Example 1 except that the comparative vinyl copolymer (RC-2) was used in place of the charge control agent vinyl copolymer (C-1). Measurement and evaluation were made in the same manner as in Example 1 to obtain the results shown in Tables 2 and 3.

Example 13

Using an image-forming apparatus mounted with the process cartridge shown in FIG. 7 and using the magnetic toner (1), images were reproduced in the same manner as in Example 1.

Evaluation was made in the same manner as in Example 1. As a result, like Example 1, stable and good results were obtained in respect of all of image density, fog and image quality from the initial stage up to after the running. Moreover, the results were good also in regard to images formed after leaving in a high-humidity environment.

TABLE 2

| | | Toner | | | | | |
|---|---|---|---|---|---|---|---|
| | | Vinyl copolymer | | Weight = average particle diameter (μm) | 10.1 μm or larger particles (vol. %) | Toner Dielectric dissipation factor | |
| | Toner | Type | Amt. (pbw) | | | Maximum value | at temp. of: |
| Example: | | | | | | | |
| 1 | Magnetic (1) | C-1 | 2 | 7.0 | 5.6 | $5.2 \times 10^{-2}$ | 125° C. |
| 2 | Magnetic (2) | C-2 | 2 | 7.3 | 6.0 | $4.8 \times 10^{-2}$ | 124° C. |
| 3 | Magnetic (3) | C-3 | 2 | 7.5 | 6.5 | $5.2 \times 10^{-2}$ | 125° C. |
| 4 | Magnetic (4) | C-4 | 2 | 7.8 | 7.0 | $5.0 \times 10^{-2}$ | 125° C. |
| 5 | Magnetic (5) | C-5 | 2 | 6.2 | 3.8 | $4.4 \times 10^{-2}$ | 124° C. |
| 6 | Magnetic (6) | C-5 | 2 | 6.2 | 3.8 | $4.6 \times 10^{-2}$ | 124° C. |
| 7 | Magnetic (7) | C-5 | 2 | 6.2 | 3.8 | $4.2 \times 10^{-2}$ | 124° C. |
| 8 | Magnetic (8) | C-5 | 2 | 6.2 | 3.8 | $6.1 \times 10^{-2}$ | 105° C. |
| 9 | Magnetic (9) | C-5 | 2 | 6.2 | 3.8 | $4.7 \times 10^{-2}$ | 110° C. |
| 10 | Magnetic (10) | C-5 | 2 | 6.2 | 3.8 | $4.4 \times 10^{-2}$ | 124° C. |
| 11 | Non-magnetic (1) | C-1 | 2 | 7.2 | 5.8 | $7.5 \times 10^{-2}$ | 126° C. |
| 12 | Non-magnetic (2) | C-2 | 2 | 6.9 | 4.4 | $6.3 \times 10^{-2}$ | 126° C. |
| Comparative Example: | | | | | | | |
| 1 | Cp. magnetic (1) | RC-1 | 2 | 7.0 | 5.6 | $3.7 \times 10^{-2}$ | 123° C. |
| 2 | Cp. magnetic (2) | — | | 7.0 | 5.6 | $8.8 \times 10^{-2}$ | 125° C. |
| 3 | Cp. magnetic (3) | RC-2 | 2 | 7.0 | 5.6 | $3.9 \times 10^{-2}$ | 123° C. |

TABLE 3

| | Evaluation of developing performance | | | | | | |
|---|---|---|---|---|---|---|---|
| | Running initial stage | | | At finish of running | | | Image |
| | Image density | Fog | Image quality | Image density | Fog | Image quality | density stability |
| Example: | | | | | | | |
| 1 | 1.40 | Rank 4 | Rank 4 | 1.36 | Rank 4 | Rank 4 | Rank 4 |
| 2 | 1.42 | Rank 4 | Rank 5 | 1.39 | Rank 4 | Rank 5 | Rank 5 |
| 3 | 1.41 | Rank 5 | Rank 4 | 1.37 | Rank 5 | Rank 4 | Rank 5 |
| 4 | 1.40 | Rank 5 | Rank 5 | 1.39 | Rank 4 | Rank 5 | Rank 5 |
| 5 | 1.44 | Rank 5 | Rank 5 | 1.40 | Rank 5 | Rank 5 | Rank 5 |
| 6 | 1.44 | Rank 5 | Rank 5 | 1.42 | Rank 5 | Rank 5 | Rank 5 |
| 7 | 1.43 | Rank 5 | Rank 5 | 1.41 | Rank 5 | Rank 5 | Rank 5 |
| 8 | 1.41 | Rank 5 | Rank 5 | 1.38 | Rank 5 | Rank 5 | Rank 5 |
| 9 | 1.40 | Rank 5 | Rank 5 | 1.38 | Rank 5 | Rank 5 | Rank 5 |
| 10 | 1.41 | Rank 5 | Rank 5 | 1.37 | Rank 5 | Rank 5 | Rank 4 |
| 11 | 1.40 | Rank 5 | Rank 5 | 1.36 | Rank 4 | Rank 4 | Rank 5 |
| 12 | 1.37 | Rank 4 | Rank 4 | 1.35 | Rank 4 | Rank 4 | Rank 4 |
| Comparative Example: | | | | | | | |
| 1 | 1.32 | Rank 1 | Rank 2 | 1.27 | Rank 1 | Rank 1 | Rank 1 |
| 2 | 1.32 | Rank 2 | Rank 2 | 1.30 | Rank 1 | Rank 1 | Rank 2 |
| 3 | 1.30 | Rank 1 | Rank 2 | 1.25 | Rank 1 | Rank 1 | Rank 1 |

What is claimed is:

1. A negatively chargeable toner comprising i) negatively chargeable toner particles containing at least a binder resin, a colorant and a vinyl copolymer and ii) an inorganic fine powder;

said negatively chargeable toner having a weight average particle diameter of from 4 $\mu$m to 12 $\mu$m, and containing, in particle size distribution of the toner, less than 50% by volume of particles of 10.1 $\mu$m or more in particle diameter; and said vinyl copolymer being a vinyl copolymer obtained by copolymerizing a monomer composition which contains at least a vinyl monomer (A) represented by the following formula (1):

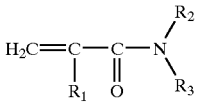

(1)

wherein $R_1$ represents a hydrogen atom or a methyl group; and $R_2$ and $R_3$ each represent a hydrogen atom or an alkyl group which may be substituted with a substituent except for an acid group, or $R_2$ and $R_3$ may be combined to form an organic group to form a cyclic structure together with the nitrogen atom; and a vinyl monomer (B) having as a functional group a carboxyl group or a carboxyl group made into salt structure, wherein the vinyl monomer (A) and the vinyl monomer (B) are copolymerized (i) in an amount from 0.5% by weight to 20% by weight of each and (ii) in a proportion by weight from 1:5 to 3:1.

2. The negatively chargeable toner according to claim 1, wherein said vinyl copolymer is a copolymer obtained by copolymerization of the vinyl monomer represented by the formula (1), the vinyl monomer having as a functional group a carboxyl group or a carboxyl group made into salt structure, and a styrene monomer.

3. The negatively chargeable toner according to claim 1, wherein said vinyl copolymer contains the vinyl monomer represented by the formula (1) and the vinyl monomer having as a functional group a carboxyl group or a carboxyl group made into salt structure, each in an amount of from 2% by weight to 15% by weight.

4. The negatively chargeable toner according to claim 1, wherein said vinyl monomer having as a functional group a carboxyl group or a carboxyl group made into salt structure is a vinyl monomer represented by the following formula (2) or (3):

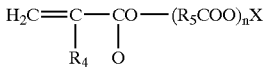

(2)

wherein $R_4$ represents a hydrogen atom or a methyl group; $R_5$ represents an alkylene group having 2 to 6 carbon atoms; n represents an integer of 0 to 10; and X represents a hydrogen atom, an alkali metal, an alkaline earth metal or a quaternary ammonium group; or

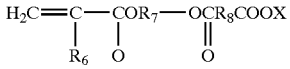

(3)

wherein $R_6$ represents a hydrogen atom or a methyl group; $R_7$ represents an alkylene group having 2 to 4 carbon atoms; $R_8$ represents an ethylene group, a vinylene group, a 1,2-cyclohexylene group or a phenylene group; and X represents a hydrogen atom, an alkali metal, an alkaline earth metal or a quaternary ammonium group.

5. The negatively chargeable toner according to claim 1, wherein said vinyl copolymer has a weight-average molecular weight Mw of from 2,000 to 200,000.

6. The negatively chargeable toner according to claim 1, wherein said vinyl copolymer has a weight-average molecular weight Mw of from 10,000 to 50,000.

7. The negatively chargeable toner according to claim 1, wherein said vinyl copolymer has a glass transition temperature Tg of from 50° C. to 120° C.

8. The negatively chargeable toner according to claim 1, wherein said vinyl copolymer has a glass transition temperature Tg of from 70° C. to 100° C.

9. The negatively chargeable toner according to claim 1, wherein said vinyl copolymer has an acid value of from 5 mg·KOH/g to 50 mg·KOH/g.

10. The negatively chargeable toner according to claim 1, wherein said vinyl copolymer has an acid value of 10 mg·KOH/g to 40 mg·KOH/g.

11. The negatively chargeable toner according to claim 1, which contains said vinyl copolymer in an amount of from 0.1% by weight to 20% by weight.

12. The negatively chargeable toner according to claim 1, which contains said vinyl copolymer in an amount of from 0.5% by weight to 10% by weight.

13. The negatively chargeable toner according to claim 1, which has, in its dielectric dissipation factor tan δ measured at a frequency of 100 kHz, a maximum value of from $2.5\times10^{-2}$ to $10.0\times10^{-2}$ in the range of temperature of from 100° C. to 130° C.

14. The negatively chargeable toner according to claim 13, wherein the maximum value of the dielectric dissipation factor tan δ is from $3.0\times10^{-2}$ to $9.0\times10^{-2}$.

15. The negatively chargeable toner according to claim 13, wherein the maximum value of the dielectric dissipation factor tan δ is from $4.0\times10^{-2}$ to $8.0\times10^{-2}$.

16. The negatively chargeable toner according to claim 1, wherein said binder resin is a styrene polymer, a styrene copolymer or a mixture of these.

17. The negatively chargeable toner according to claim 1, wherein said binder resin contains 50% by weight or more of a polyester resin.

18. The negatively chargeable toner according to claim 1, wherein said binder resin contains a hybrid resin component comprising a polyester unit and a vinyl copolymer.

19. The negatively chargeable toner according to claim 1, wherein said inorganic fine powder has a BET specific surface area of 30 $m^2/g$ or more and has a hydrophobicity of 30% or more as methanol wettability.

20. The negatively chargeable toner according to claim 1, wherein said inorganic fine powder is at least one inorganic oxide selected from the group consisting of silica, alumina, titanium oxide and a compound oxide of any of these.

21. The negatively chargeable toner according to claim 1, wherein said inorganic fine powder is a fine silica powder having been treated with a silicone oil.

22. The negatively chargeable toner according to claim 21, wherein said inorganic fine powder is a fine silica powder having a BET specific surface area of 30 $m^2/g$ or more and having a hydrophobicity of 30% or more as methanol wettability.

23. An image-forming method comprising:

a developing step of developing an electrostatic latent image held on an image-bearing member for holding thereon the electrostatic latent image, by the use of a negatively chargeable toner to form a negatively chargeable toner image;

a transfer step of transferring the negatively chargeable toner image formed on the image-bearing member, to a recording medium via, or not via, an intermediate transfer member; and a fixing step of heat-fixing to the recording medium the negatively chargeable toner image transferred to the recording medium;

said negatively chargeable toner being the negatively chargeable toner according to any one of claims 1 to 22.

24. A process cartridge constructed detachably mountable to the main body of an image-forming apparatus;

said process cartridge comprising an image-bearing member and a developing means which are supported as one unit; said developing means developing an electrostatic latent image held on the image-bearing member, by the use of a negatively chargeable toner to form a negatively chargeable toner image;

said negatively chargeable toner being the negatively chargeable toner according to any one of claims 1 to 22.

* * * * *

UNITED STATES PATENT AND TRADEMARK OFFICE

CERTIFICATE OF CORRECTION

PATENT NO. : 6,846,601 B2
DATED : January 25, 2005
INVENTOR(S) : Minoru Shimojo et al.

It is certified that error appears in the above-identified patent and that said Letters Patent is hereby corrected as shown below:

Column 10,

Formula 6, "

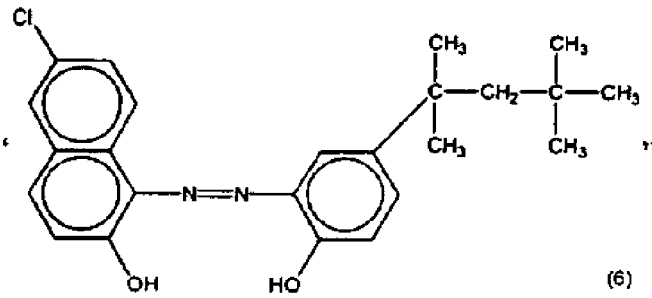

" should read

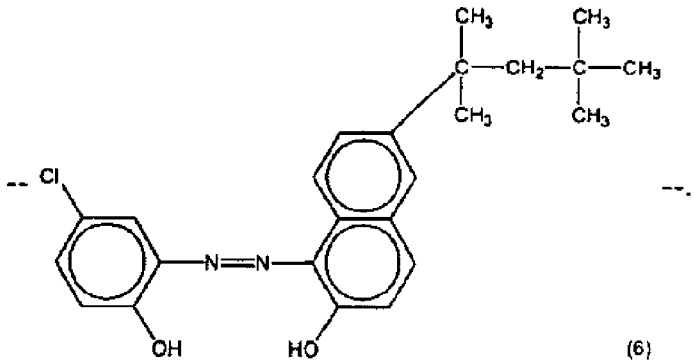

--.

Column 26,
Line 27, "forward/backward," should read -- forward/backward --.

Column 31,
Line 34, "Element" should be deleted; and
Line 35, "(s)" should read -- Element(s) --.

Column 44,

Line 10, "

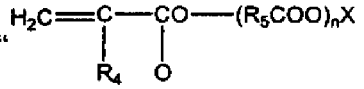

" should read

--

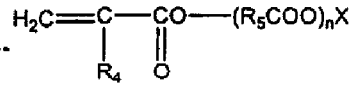

--;

UNITED STATES PATENT AND TRADEMARK OFFICE

CERTIFICATE OF CORRECTION

PATENT NO. : 6,846,601 B2
DATED : January 25, 2005
INVENTOR(S) : Minoru Shimojo et al.

It is certified that error appears in the above-identified patent and that said Letters Patent is hereby corrected as shown below:

Column 44 (cont.),

Line 21, " 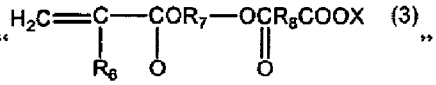 " should read

-- 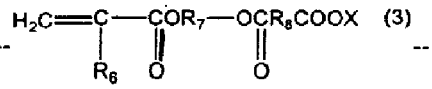 --.

Signed and Sealed this

Seventh Day of June, 2005

JON W. DUDAS
*Director of the United States Patent and Trademark Office*